US009006679B2

(12) United States Patent
Morokuma et al.

(10) Patent No.: US 9,006,679 B2
(45) Date of Patent: Apr. 14, 2015

(54) MASS SPECTROMETER

(71) Applicant: Hitachi High-Technologies Corporation, Tokyo (JP)

(72) Inventors: Hidetoshi Morokuma, Hitachinaka (JP); Koji Ishiguro, Hitachinaka (JP); Shun Kumano, Kokubunji (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 13/909,299

(22) Filed: Jun. 4, 2013

(65) Prior Publication Data

US 2013/0320207 A1 Dec. 5, 2013

(30) Foreign Application Priority Data

Jun. 4, 2012 (JP) ..... 2012-126926

(51) Int. Cl.

| | |
|---|---|
| ***H01J 49/04*** | (2006.01) |
| ***H01J 49/26*** | (2006.01) |
| ***H01J 49/24*** | (2006.01) |
| ***H01J 49/00*** | (2006.01) |
| *H01J 49/10* | (2006.01) |

(52) U.S. Cl.

CPC ..... *H01J 49/0495* (2013.01); *H01J 49/24* (2013.01); *H01J 49/0404* (2013.01); *H01J 49/00* (2013.01); *H01J 49/04* (2013.01); *H01J 49/0409* (2013.01); *H01J 49/0431* (2013.01); *H01J 49/10* (2013.01)

(58) Field of Classification Search

CPC ... H01J 49/0495; H01J 49/24; H01J 49/0404; H01J 49/00; H01J 49/04; H01J 49/10; H01J 49/413; H04J 49/0431

USPC ..... 250/288, 423 R, 428, 430, 432 R, 433

See application file for complete search history.

(56) References Cited

U.S. PATENT DOCUMENTS

| | | | | |
|---|---|---|---|---|
| 3,596,087 | A * | 7/1971 | Heath | 250/426 |
| 4,388,531 | A * | 6/1983 | Stafford et al. | 250/427 |
| 4,590,371 | A * | 5/1986 | Ottley | 250/289 |
| 4,849,628 | A | 7/1989 | McLuckey et al. | |
| 4,852,551 | A * | 8/1989 | Opie et al. | 600/121 |
| 7,064,320 | B2 | 6/2006 | Yamada et al. | |
| 7,592,589 | B2 | 9/2009 | Hashimoto et al. | |

(Continued)

FOREIGN PATENT DOCUMENTS

| | | | | |
|---|---|---|---|---|
| JP | 10275588 | A * | 10/1998 | H01J 49/16 |
| JP | 11002360 | A * | 1/1999 | F16K 51/02 |
| WO | WO 2009/023361 | A2 | 2/2009 | |

*Primary Examiner* — Michael Logie
(74) *Attorney, Agent, or Firm* — Baker Botts L.L.P.

(57) ABSTRACT

Provided is a mass spectrometer capable of easy exchange of a measurement sample and suppressing a carryover. The mass spectrometer includes a mass spectrometry section, an ion source the internal pressure of which is reduced by a differential pumping from the mass spectrometry section and the ion source ionizes the sample gas, a sample container in which the sample gas is generated by vaporizing the measurement sample, a thin pipe that introduces the sample gas generated in the sample container into the ion source, an elastic tube of openable and closable that connects the sample container and the thin pipe, a pair of weirs that closes or opens the elastic tube so as to sandwich the elastic tube, and a cartridge that integrates the sample container, the thin pipe, and the elastic tube, and is detachable in a lump from a main body of the mass spectrometer.

7 Claims, 15 Drawing Sheets

(56) References Cited

U.S. PATENT DOCUMENTS

| | | | | |
|---|---|---|---|---|
| 7,977,629 | B2 * | 7/2011 | McEwen et al. | 250/288 |
| 2004/0256973 | A1 * | 12/2004 | Imamura | 313/483 |
| 2008/0044585 | A1 * | 2/2008 | Suh et al. | 427/457 |
| 2010/0264307 | A1 * | 10/2010 | Nakano | 250/288 |
| 2010/0301209 | A1 * | 12/2010 | Ouyang et al. | 250/288 |
| 2011/0253891 | A1 * | 10/2011 | Hashimoto et al. | 250/288 |
| 2012/0112061 | A1 * | 5/2012 | Morokuma et al. | 250/288 |
| 2012/0326022 | A1 * | 12/2012 | Kumano et al. | 250/282 |
| 2013/0032711 | A1 * | 2/2013 | Ishiguro et al. | 250/288 |
| 2013/0056633 | A1 * | 3/2013 | Hashimoto et al. | 250/288 |

* cited by examiner

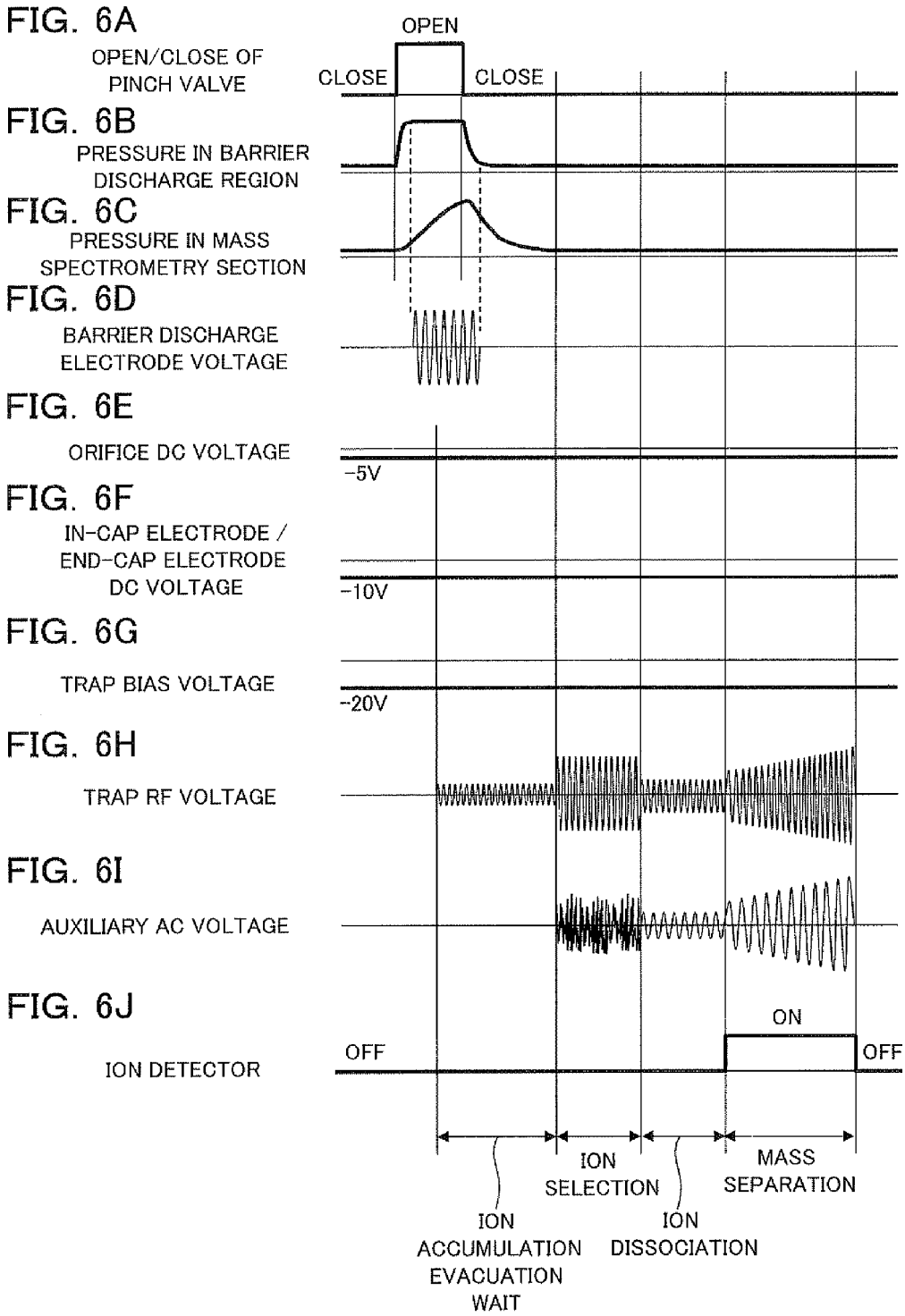
FIG. 6A
OPEN/CLOSE OF PINCH VALVE
OPEN
CLOSE
CLOSE
FIG. 6B
PRESSURE IN BARRIER DISCHARGE REGION
FIG. 6C
PRESSURE IN MASS SPECTROMETRY SECTION
FIG. 6D
BARRIER DISCHARGE ELECTRODE VOLTAGE
FIG. 6E
ORIFICE DC VOLTAGE
-5V
FIG. 6F
IN-CAP ELECTRODE / END-CAP ELECTRODE DC VOLTAGE
-10V
FIG. 6G
TRAP BIAS VOLTAGE
-20V
FIG. 6H
TRAP RF VOLTAGE
FIG. 6I
AUXILIARY AC VOLTAGE
FIG. 6J
ION DETECTOR
OFF
ON
OFF
ION ACCUMULATION EVACUATION WAIT
ION SELECTION
ION DISSOCIATION
MASS SEPARATION

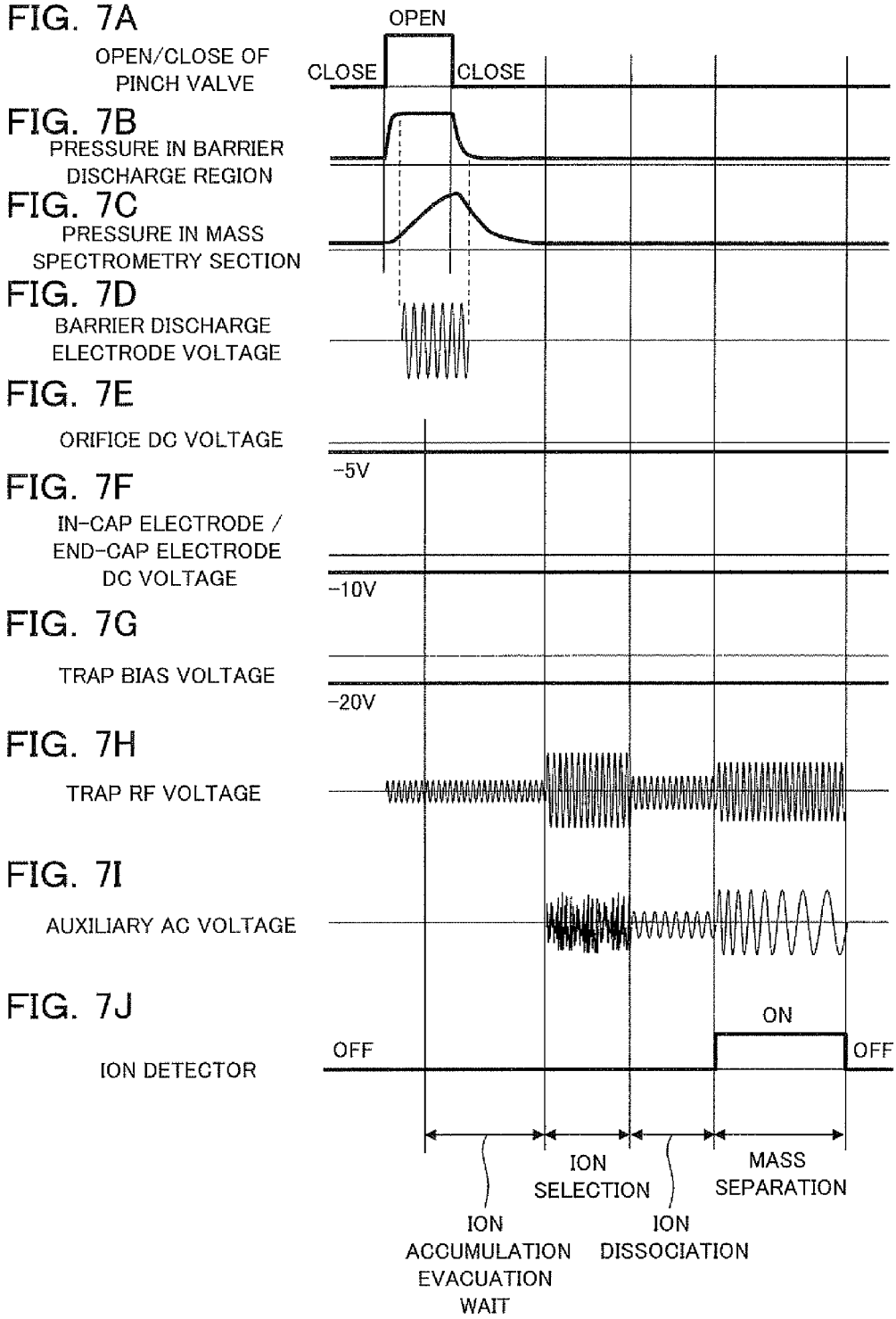
FIG. 7A
OPEN/CLOSE OF PINCH VALVE
OPEN
CLOSE
CLOSE
FIG. 7B
PRESSURE IN BARRIER DISCHARGE REGION
FIG. 7C
PRESSURE IN MASS SPECTROMETRY SECTION
FIG. 7D
BARRIER DISCHARGE ELECTRODE VOLTAGE
FIG. 7E
ORIFICE DC VOLTAGE
-5V
FIG. 7F
IN-CAP ELECTRODE / END-CAP ELECTRODE DC VOLTAGE
-10V
FIG. 7G
TRAP BIAS VOLTAGE
-20V
FIG. 7H
TRAP RF VOLTAGE
FIG. 7I
AUXILIARY AC VOLTAGE
FIG. 7J
ION DETECTOR
OFF
ON
OFF
ION ACCUMULATION EVACUATION WAIT
ION SELECTION
ION DISSOCIATION
MASS SEPARATION

MASS SPECTROMETER

CROSS REFERENCE TO RELATED APPLICATIONS

This application claims the foreign priority benefit under Title 35, United States Code, 119 (a)-(d) of Japanese Patent Application No. 2012-126926, filed on Jun. 4, 2012 in the Japan Patent Office, the disclosure of which is herein incorporated by reference in its entirety.

TECHNICAL FIELD

The present invention relates to a mass spectrometer, and more particularly to a mass spectrometer suitable for a reduction in size and weight.

BACKGROUND ART

In a mass spectrometer, an ionized measurement sample (sample gas) is mass analyzed at a mass spectrometry section. While the mass spectrometry section is housed in a vacuum chamber and kept at a high vacuum of 0.1 Pa or less, an ionization of the sample gas is performed by a method to be ionized at atmospheric pressure as described in Patent Document 1 or by a method to be ionized in a reduced pressure of about 10 to 100 Pa as described in Patent Document 2. Accordingly, there is a difference between a pressure under an environment for performing the ionization and a pressure under an environment for performing the mass spectrometry. Therefore, a differential pumping scheme as described in Patent Document 3 has been proposed in order to introduce the ionized sample gas into the mass spectrometry section while keeping a degree of vacuum (pressure) in the mass spectrometry section within a range at which mass spectrometry is possible. In Patent Document 4, a scheme of introducing intermittently the ionized sample gas into the mass spectrometry section has been proposed in addition to the differential pumping scheme.

CITATION LIST

Patent Literature

{Patent Document 1}
U.S. Pat. No. 7,064,320
{Patent Document 2}
U.S. Pat. No. 4,849,628
{Patent Document 3}
U.S. Pat. No. 7,592,589
{Patent Document 4}
WO Pub. No. 2009/023361

SUMMARY OF INVENTION

Technical Problem

According to the method of introducing intermittently the ionized sample gas into the mass spectrometry section in Patent Document 4, the degree of vacuum of the mass spectrometry section, which has been reduced by the introduction of the ionized sample gas, can be recovered while stopping the introduction, thereby performing the mass spectrometry under high vacuum. This method is advantageous to the reduction in size and weight of the mass spectrometer, because the mass spectrometry section can be in high vacuum even with a small vacuum pump.

However, in the method of introducing intermittently the ionized sample gas into the mass spectrometry section in Patent Document 4, there is a possibility to cause a carryover problem (contamination problem) in which a sample gas measured previously remains in a stainless steel thin pipe for adjusting an amount of the sample gas to be intermittently introduced or in a silicone tube which is opened or closed by a pinch valve. As a countermeasure, a means for heating the stainless steel thin pipe or the silicone tube to prevent the contamination is developed. However, this means is not suitable for the reduction in size and weight of the mass spectrometer, because it leads to expansion of a heater, a power supply for the heater, or the like. Further, in general, it is necessary to heat the pipe or the like to 200° C. or higher for preventing the contamination by heating, however, it is considered that heating the silicone tube to 200° C. or higher is not appropriate.

Therefore, it is desirable that a part such as a stainless steel thin pipe and a silicone tube, where there is a possibility to cause the contamination problem, is replaced for each measurement (exchange of a measurement sample). However, the work of mass spectrometry should not be complicated by this replacement work newly created. In other words, it is useful if the part, where there is a possibility that the contamination problem (carryover problem) occurs, can be replaced along with the exchange of the measurement sample.

Accordingly, the objective of the present invention is to present a mass spectrometer capable of easy exchange of a measurement sample and suppressing the carryover.

Solution to Problem

To solve the above problems, one of the aspect of the present invention is a mass spectrometer including a mass spectrometry section that separates an ionized sample gas, an ion source that has an internal pressure thereof reduced by differential pumping from the mass spectrometry section and ionizes the sample gas, a sample container in which a measurement sample is placed and the sample gas is generated by vaporizing the measurement sample, a thin pipe that introduces the sample gas generated in the sample container into the ion source, an elastic tube of openable and closable, that connects the sample container and the thin pipe, a weir that closes or opens the elastic tube by pinching or releasing the elastic tube, and a cartridge that integrates the sample container, the thin pipe, and the elastic tube, and is detachable in a lump from a main body of the mass spectrometer.

In addition, another aspect of the present invention is amass spectrometer including amass spectrometry section that separates an ionized sample gas, an ion source that has an internal pressure thereof reduced by differential pumping from the mass spectrometry section and ionizes the sample gas, a thin pipe that introduces the sample gas into the ion source, an insertion hole which is provided on the ion source and connects the thin pipe and the ion source while sealing a gap between the thin pipe and the insertion hole by inserting the thin pipe through the insertion hole, and disconnects the thin pipe from the ion source by removing the thin pipe, and an on-off valve for opening and closing the insertion hole, wherein the thin pipe and the on-off valve approach each other in accordance with the forward movement of the thin pipe to be inserted to the insertion hole, and the on-off valve starts the valve opening to pass the thin pipe through the insertion hole when the distance between the thin pipe and the on-off valve is shortened to a first predetermined distance, and the thin pipe is removed and away from the through hole in accordance with the backward movement of the thin pipe to be removed from the insertion hole, and the on-off valve completes the valve closing when the distance between the thin pipe and the insertion hole is lengthened to a second predetermined distance.

Advantageous Effects of Invention

According to the present invention, it is possible to provide a mass spectrometer capable of easy exchange of a measurement sample and suppressing a carryover. Technical problems, configurations and advantageous effects of the present invention other than described above, will be apparent from the following description of embodiments.

BRIEF DESCRIPTION OF DRAWINGS

FIGS. 6A to 6J are graphs showing open/close of the pinch valve (FIG. 6A), a pressure of a barrier discharge region (FIG. 6B), a pressure of the mass spectrometry section (FIG. 6C), a barrier discharge electrode alternating-current (AC) voltage (FIG. 6D), an orifice DC voltage (FIG. 6E), an in-cap electrode/end-cap electrode DC voltage (FIG. 6F), a trap-bias DC voltage (FIG. 6G), a trap RF voltage (FIG. 6H), an auxiliary AC voltage (FIG. 6I), and ON/OFF of an ion detector (FIG. 6J), in association with a sequence (ion accumulation—evacuation wait time—ion selection—ion dissociation—mass scan (mass separation)) of the mass spectrometry (voltage sweep scheme) in the mass spectrometry section.

FIGS. 7A to 7J are graphs showing open/close of the pinch valve (FIG. 7A), a pressure of a barrier discharge region (FIG. 7B), a pressure of the mass spectrometry section (FIG. 7C), a barrier discharge electrode AC voltage (FIG. 7D), an orifice DC voltage (FIG. 7E), an in-cap electrode/end-cap electrode DC voltage (FIG. 7F), a trap-bias DC voltage (FIG. 7G), a trap RF voltage (FIG. 7H), an auxiliary AC voltage (FIG. 7I), and ON/OFF of an ion detector (FIG. 7J), in association with a sequence (ion accumulation—evacuation wait time—ion selection—ion dissociation—mass scan (mass separation)) of the mass spectrometry (frequency sweep scheme) in the mass spectrometry section.

DESCRIPTION OF EMBODIMENTS

Figure 1A:
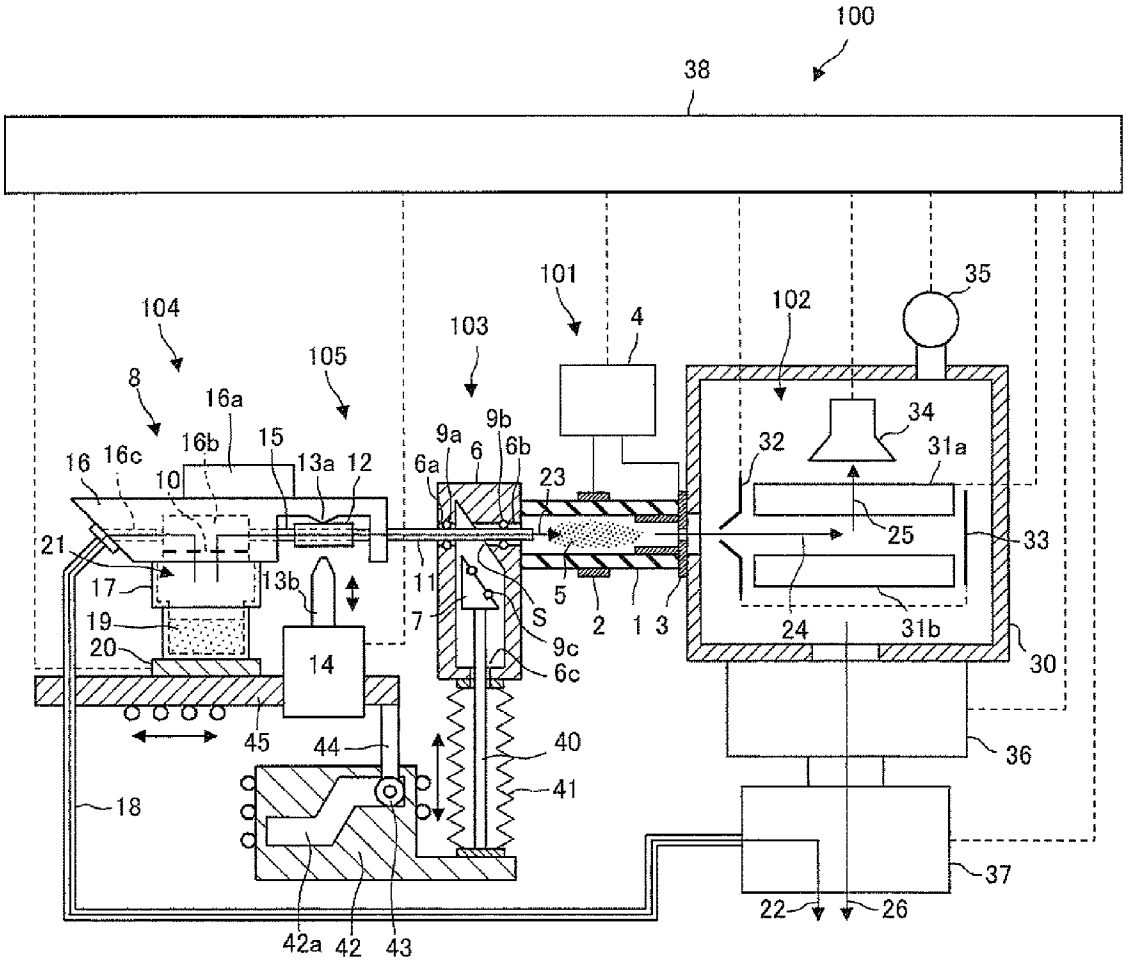
FIG. 1A is a block diagram of a mass spectrometer according to a first embodiment of the present invention.

Next, an embodiment of the present invention will be described in detail with reference to the drawings as appropriate. In each FIG., the same components as those in other FIGS. are assigned with the same reference numerals, and the duplicate description thereof will be omitted.

First Embodiment

FIG. 1A is a block diagram of a mass spectrometer 100 according to a first embodiment of the present invention. The mass spectrometer 100 includes a vacuum chamber 30. A turbomolecular pump 36 and a roughing pump 37 are connected in series to the vacuum chamber 30. In this manner, the vacuum chamber 30 can be evacuated to a high vacuum pressure approximately 0.1 Pa or less. The vacuum chamber 30 is provided with a vacuum gauge 35, and the degree of vacuum (pressure) in the vacuum chamber 30 can be measured. The degree of vacuum measured is transmitted to a control circuit 38. The control circuit 38 controls the turbomolecular pump 36 and the roughing pump 37 on the basis of the degree of vacuum received. A mass spectrometry section 102 is accommodated in the vacuum chamber 30. Although details will be described later, the mass spectrometry section 102 is capable of performing ion accumulation, evacuation wait, ion selection, ion dissociation, mass scan, and so on, and capable of separating target ions from a measurement sample 19 ionized.

The vacuum chamber 30 is provided with an orifice 3 at an inlet for introducing the measurement sample 19 ionized. A pore diameter of the orifice 3 may be approximately $\phi$0.1 mm to $\phi$1 mm. An ion source 101 is connected to the orifice 3. The ion source 101 includes a dielectric container (dielectric bulkhead) 1 and barrier discharge electrodes 2. The dielectric container 1 has openings at both ends and is in pipe shape. One end opening is connected to the vacuum chamber 30 through the orifice 3. The other end opening is connected to a slide valve container (valve container) 6 of a slide valve 103. A thin pipe (capillary) 11 is inserted into the dielectric container 1 from the other end opening thereof through the slide valve container 6. Since the thin pipe 11 suppresses the measurement sample 19 and the like from flowing into the dielectric container 1, the dielectric container 1 is differentially pumped to be depressurized via the orifice 3.

Between the barrier discharge electrodes 2 and the orifice 3, an AC voltage and a DC voltage can be applied via the dielectric container (dielectric bulkhead) 1. Lines of magnetic force and lines of electric force which are generated between the barrier discharge electrodes 2 and the orifice 3 penetrates the dielectric container 1. The AC voltage is applied to the barrier discharge electrodes 2 by a barrier discharge AC power supply 4, and the DC voltage is applied to the orifice 3. Controls such as ON/OFF of the AC voltage and the DC voltage are performed by the control circuit 38. Electric charges which are charged inside of the dielectric container 1 by application of the AC voltage are discharged to the orifice 3. Plasma and thermal electrons, which are generated during the discharge, ionize a sample gas which is vaporized measurement sample 19 flowing through the dielectric container 1.

The slide valve 103 includes the slide valve container (valve container) 6, an outside insertion hole 6*a*, an insertion hole 6*b*, and an through hole 6*c*, which are three holes penetrating from the outside to the inside of the slide valve container 6. The slide valve container 6 is connected to the ion source 101 via the insertion hole 6*b*. The outside insertion hole 6*a* and the insertion hole 6*b* are substantially equal to each other in their pore diameters, which are approximately ϕ3 mm, and arranged so that central axes thereof coincide with each other on one straight line. The central axis of the outside insertion hole 6*a* coincides with an extension of the central axis of the insertion hole 6*b*. Accordingly, the thin pipe 11 is able to penetrate simultaneously the outside insertion hole 6*a* and the insertion hole 6*b*. Therefore, the outside insertion hole 6*a* functions as a guide which makes the thin pipe 11 move forward to the direction of the insertion hole 6*b*. The outside air is communicated with the inside of the slide valve container 6 through the outside insertion hole 6*a*, and the inside of the slide valve container 6 is communicated with the inside of the dielectric container 1 through the insertion hole 6*b*. Therefore, the insertion hole 6*b* can be considered to be provided on the ion source 101 (dielectric container 1). A second O-ring 9*b* is disposed on the insertion hole 6*b*, and it is possible to hermetically connect the thin pipe 11 and the ion source 101 while sealing a gap between the thin pipe 11 and the insertion hole 6*b* by inserting the thin pipe 11. On the contrary, it is possible to disconnect the thin pipe 11 from the ion source 101 by removing the thin pipe 11 from the insertion hole 6*b* (ion source 101). In the same manner, the outside insertion hole 6*a* is provided on the slide valve container 6, and a first O-ring 9*a* is disposed on the outside insertion hole 6*a*. It is possible to hermetically connect the thin pipe 11 and the slide valve container 6 while sealing a gap between the thin pipe 11 and the outside insertion hole 6*a* by inserting the thin pipe 11 from the outside insertion hole 6*a* into the slide valve container 6. On the contrary, it is possible to disconnect the thin pipe 11 from the slide valve container 6, and separate them each other, thereby detaching a cartridge 8 including the thin pipe 11 from a main body of the mass spectrometer 100, by removing the thin pipe 11 from the outside insertion hole 6*a* (slide valve container 6). A valving element shaft 40 penetrates the through hole 6*c*.

The slide valve 103 includes a slide valve valving element 7 which is provided in the slide valve container 6 and the valving element shaft 40 which supports the slide valve valving element 7. The slide valve valving element 7 is capable of blocking an opening surface S of the insertion hole 6*b* from the inside of the slide valve container 6, thereby closing the slide valve 103. A periphery of the opening surface S can be considered as a valve seat relative to the slide valve valving element 7. A valve including the valving element and the valve seat can be considered as the slide valve (on-off valve) 103. In this case, the slide valve container 6 can be considered to accommodate the slide valve 103. A valving element O-ring 9*c* is attached to the slide valve valving element 7 in order to increase the tightness during blocking the insertion hole 6*b*. The valving element O-ring 9*c* is disposed on a surface opposing the opening surface S of the insertion hole 6*b*, and it is possible to securely block the opening surface S with the slide valve valving element 7 and the valving element O-ring 9*c*.

The slide valve 103 includes the first O-ring 9*a* which seals the outside insertion hole 6*a*, the second O-ring 9*b* which seals the insertion hole 6*b*, and a vacuum bellows 41 which covers an exposed portion of the valving element shaft 40 that seals and penetrates the through hole 6*c*. The slide valve valving element 7 is connected to one end of the valving element shaft 40. The slide valve valving element 7 is capable of opening and closing the insertion hole 6*b* to open and close the slide valve 103, by moving the valving element shaft 40 from the outside of the slide valve container 6. The portion of the valving element shaft 40 outside of the slide valve container 6 is covered with the vacuum bellows 41 so that the valving element shaft 40 can move to be pulled out and pushed in without vacuum deterioration. The other end of the valving element shaft 40 is connected to a grooved cam (driven slider, linear motion driven member) 42. The grooved cam (driven slider, linear motion driven member) 42 is movable in the vertical direction on the drawing. The grooved cam (driven slider, linear motion driven member) 42 moves integrally with the valving element shaft 40 and the slide valve valving element 7.

A cam slot 42*a* is formed on the grooved cam 42. A guide roller (follower) 43, which is constrained in the cam slot 42*a* so as to move along the cam slot 42*a*, is provided in the cam slot 42*a*. The guide roller (follower) 43 is attached to a sample introduction section base (driving slider, rectilinear motion driving member) 45 via a guide roller shaft 44. A sample introduction section 104 including the cartridge 8 is secured to be mounted on the sample introduction section base 45. The sample introduction section base 45 is slidable in the direction along the thin pipe 11 (left-right direction on the drawing). On the other hand, the grooved cam 42 is slidable in the direction along the valving element shaft 40 (vertical direction on the drawing). That is, the sample introduction section base 45 moves in the left-right direction on the drawing as the rectilinear motion driving member. The grooved cam 42, which is the linear motion driven member relative to the rectilinear driving member, moves in the vertical direction on the drawing (so called linear motion) relative to the left-right direction of the movement of the sample introduction section base 45, in conjunction with the movement of the sample introduction section base 45. The sample introduction section base 45 functions as the driving slider which moves in the left-right direction on the drawing, and the grooved cam 42 moves in the perpendicular direction relative to the moving direction of the driving slider in conjunction with the movement of the driving slider.

When the sample introduction section base 45 slides in the front-back direction along the moving direction of the thin pipe 11, the thin pipe 11 slides integrally with the sample introduction section base 45, and it is possible to insert or remove the thin pipe 11 into or from the dielectric container 1 through the insertion hole 6*b*. When the sample introduction section base 45 slides in this manner, the grooved cam 42 is slid in the direction along the valving element shaft 40 by the cam slot 42*a* and the guide roller (follower) 43, so that the slide valve valving element 7 opens or closes the insertion hole 6*b* which is communicated with the dielectric container 1. Although details will be described later, the slide valve valving element 7 is open when the thin pipe 11 for introducing the measurement sample (sample gas) 19 into the ion source 101 from the sample introduction section 104 is inserted into the ion source 101 (slide valve container 6), and is closed when the thin pipe 11 is removed from the ion source 101 (slide valve container 6). This open-close operation makes it possible to insert or remove the thin pipe 11 into or from the ion source 101 while maintaining the ion source 101 in a reduced pressure.

The sample introduction section 104 includes a sample container 17 which accommodates the measurement sample 19 therein, a pressure reduction pipe (pressure reduction unit) 18, a heater (heating unit) 20, a pinch valve 105, and the thin pipe 11. The sample container 17 is capped with a cartridge body (sample container cap) 16 (filter 10). The filter 10 allows a gas to pass therethrough but does not allow a liquid to pass therethrough, and prevents the measurement sample 19 from entering into the thin pipe 11 and the pressure reduction pipe 18 if the measurement sample 19 is a liquid. The sample container 17 is connected to the pressure reduction pipe (pressure reduction unit) 18 via a gas chamber 16*b* and a through hole 16*c*. The gas chamber 16*b* is provided on the cartridge body 16, and connected to the sample container 17 and an elastic tube 12. The through hole 16*c* is provided on the cartridge body 16, and penetrates from the outside of the cartridge body 16 to the gas chamber 16*b*. When the cartridge 8 is in the attachment state to a main body of the sample introduction section 104, the pressure reduction pipe 18 is connected to the through hole 16*c* and reduces a pressure in the sample container 17 via the through hole 16*c* and the gas chamber 16*b*. That is, the pressure reduction pipe 18 functions as the pressure reduction unit which reduces the pressure in the sample container 17. The pressure reduction pipe 18 is connected to the roughing pump 37, and is capable of reducing the pressure in the sample container 17. Thus, it is possible to facilitate the vaporization of the measurement sample 19. It is possible to adjust the pressure in the sample container 17 by the conductance of the pressure reduction pipe 18 and the evacuation capacity of the roughing pump 37. The heater 20 heats the sample container 17 and further the measurement sample 19. Thus, it is possible to facilitate the vaporization of the measurement sample 19. It is possible to further facilitate the vaporization of the measurement sample 19 by reducing the pressure in the sample container 17 by the pressure reduction pipe 18 and raising the temperature of the measurement sample 19 in the sample container 17 by the heater 20.

The sample introduction section 104 includes the cartridge 8. The cartridge 8 is integrated with the sample container 17, the thin pipe 11, and the elastic tube 12 by the cartridge body 16. These are members involved in a carryover. By this integration, the cartridge 8 is detachable from the main body of the sample introduction section 104 integrally with the sample container 17, the thin pipe 11, and the elastic tube 12. The heater 20 and the pressure reduction pipe 18 remain on the main body of the sample introduction section 104 and are apart from the cartridge 8, when the cartridge 8 is detached from the main body of the sample introduction section 104. Since the gas chamber 16*b* and the through hole 16*c* are formed in the cartridge body 16, they are detached integrally as the cartridge 8, when the cartridge 8 is detached from the main body of the sample introduction section 104.

The pinch valve 105 is constituted by a pair of weirs 13*a*, 13*b*, and the elastic tube 12 which is sandwiched between the two weirs 13*a*, 13*b*. The elastic tube 12 is connected to the sample container 17 and the thin pipe 11 at respective ends thereof. The elastic tube 12 is closed by being elastically deformed and squashed when an external force is applied thereto, and opened by being elastically restored to an original shape when the external force is not applied thereto, and thereby the elastic tube 12 is openable and closable. A silicone tube, a rubber tube, or the like may be used as the elastic tube 12. The pair of weirs 13*a*, 13*b* is disposed facing each other so as to sandwich the elastic tube 12, and closes or opens the elastic tube 12 by moving close to or away from each other. A fixed weir 13*a* which is one of the pair of weirs is fixed to the cartridge body 16 of the cartridge 8 so as to be close to the elastic tube 12. The fixed weir 13*a* is formed integrally on the cartridge body 16. Therefore, when the cartridge 8 is detached from the main body of the sample introduction section 104, the fixed weir 13*a* is detached together with the cartridge body 16. A moving weir 13*b* which is the other of the pair of weirs is driven by a pinch valve driving unit 14 controlled by the control circuit 38, and realizes the closed state of the valve by squashing the elastic tube 12 and realizes the open state of the valve by stopping squashing the elastic tube 12. The moving weir 13*b* moves close to or away from the fixed weir 13*a* when the cartridge 8 is in the attachment state to the sample introduction section 104. The moving weir 13*b* remains on the main body of the sample introduction section 104 and is apart from the cartridge 8, when the cartridge 8 is detached from the main body of the sample introduction section 104. The pinch valve 105 is capable of being opened or closed in a short period of time such that the valve opening time is approximately 200 msec or less. In other words, the pinch valve 105 is capable of performing an operation from a valve closed state to the next valve closed state via the valve open state, in a short period of time such as approximately 200 msec or less. The pair of weirs 13*a*, 13*b* is capable of opening (closing) the elastic tube 12 intermittently by moving away from (close to) each other intermittently.

The thin pipe 11 is connected to the elastic tube 12 at one end thereof, and connected to be inserted into the dielectric container 1 of the ion source 101 at the other end thereof. When the pinch valve 105 is open in a state where the dielectric container 1 is differentially pumped via the orifice 3, the sample gas of the measurement sample 19 in the sample container 17 flows into the dielectric container 1 via a sample gas pipe 15, the elastic tube 12 and the thin pipe 11 in this order, to generate a sample gas flow 23. In addition, since the thin pipe 11 causes a large resistance to the sample gas flow 23, the sample container 17 is also differentially pumped by the thin pipe 11. The sample gas of the measurement gas 19 is introduced into the dielectric container 1 from the sample container 17 every time the pinch valve 105 is open, and it is possible to intermittently introduce the sample gas of the measurement gas 19 into the dielectric container 1 by repeating open/close of the pinch valve 105. It is possible to adjust the amount of the sample gas to be introduced into the dielectric container 1 and the ultimate pressure increased by the introduction of the sample gas in the dielectric container 1, by varying the pressure in the sample container 17 having the reduced pressure and the valve opening time of the pinch valve 105. For example, by reducing the pressure in the sample container 17 and/or shortening the valve opening time of the pinch valve 105, it is possible to reduce the amount of the sample gas to be introduced into the dielectric container 1 and the ultimate pressure in the dielectric container 1. On the contrary, by increasing the pressure in the sample container 17 and/or lengthening the valve opening time of the pinch valve 105, it is possible to increase the amount of the sample gas to be introduced into the dielectric container 1 and the ultimate pressure in the dielectric container 1.

The sample gas, which is introduced into the dielectric container 1, is partially ionized by a barrier discharge region 5 that is generated in the dielectric container 1 by applying the AC voltage to the barrier discharge electrodes 2. An efficiency of the ionization is dependent on a density of the plasma and thermal electrons which are generated by the barrier discharge in the barrier discharge region 5. It is also possible to vary the efficiency of the ionization by a position and/or a flow rate of the sample gas when the sample gas is introduced into the barrier discharge region 5. The density of the plasma and thermal electrons is determined by the ultimate pressure in the dielectric container 1, an intensity of the AC voltage applied to the barrier discharge electrodes 2, a shape of the barrier discharge electrodes 2 generating the barrier discharge, a distance between the barrier discharge electrodes 2 and the orifice 3, and the dielectric constant and a shape of the dielectric container 1. It is possible to adjust the flow volume of the sample gas which is introduced into the dielectric container 1 with high reproducibility, by adjusting the pressure in the sample container 17 and/or the valve opening time of the pinch valve 105. Therefore, it is possible to adjust the ultimate pressure in the dielectric container 1 with high reproducibility, thereby finally adjusting the efficiency of the ionization of the sample gas with high reproducibility. It is possible to adjust a position where the sample gas is introduced into the barrier discharge region 5 by an insertion amount of the thin pipe 11 into the dielectric container 1. If the insertion amount of the thin pipe 11 is increased, the efficiency of the ionization of the sample gas is decreased because the distance the sample gas passes through the barrier discharge region 5 is shortened. On the contrary, if the insertion amount of the thin pipe 11 is decreased, the efficiency of the ionization of the sample gas is increased because the distance the sample gas passes through the barrier discharge region 5 is lengthened. It is possible to adjust the flow rate of the sample gas introduced from the thin pipe 11 by a pressure difference between the pressure in the dielectric container 1 and the pressure in the gas chamber 16*b* of the cartridge body 16 which is depressurized by the pressure reduction pipe 18, and conductances (internal diameters and lengths) of the sample gas pipe 15, the elastic tube 12, and the thin pipe 11. If the flow rate of the sample gas is increased, the efficiency of the ionization of the sample gas is decreased because a time the sample gas passes through the barrier discharge region 5 is shortened. On the contrary, if the flow rate of the sample gas is decreased, the efficiency of the ionization of the sample gas is increased because a time the sample gas passes through the barrier discharge region 5 is lengthened.

In the intermittent introduction of the sample gas of the measurement sample 19 into the dielectric container 1, open and close of the pinch valve 105 are alternately repeated. The pressure, which is increased by opening once the pinch valve 105, in the dielectric container 1, can be decreased by closing once the pinch valve 105 to the same pressure as before the pressure is increased. The pressure which has been increased once in the dielectric container 1 can be decreased gradually from the ultimate pressure with high reproducibility, by stopping introduction of the sample gas by closing the pinch valve 105, and by the differential pumping with the orifice 3. Therefore, it is possible to ensure a time the pressure in the dielectric container 1 is in a range of 100 Pa to 10,000 Pa for a long time with high reproducibility while the pressure is decreasing. It is possible to generate a dielectric barrier discharge using an atmosphere (air) as a main discharge gas under the pressure band of 100 Pa to 10,000 Pa. When the pinch valve 105 is opened and closed intermittently, the sample gas in a headspace 21 of the sample container 17 is introduced intermittently into the inside of the dielectric container 1 of the ion source 101 through the elastic tube 12 and the thin pipe 11. When the voltage for the barrier discharge region 5 is applied to the barrier discharge electrodes 2 in accordance with the timing at which the sample gas is intermittently introduced, the plasma and thermal electrons are generated by the barrier discharge in the barrier discharge region 5. By adjusting the intensity and/or the applying time of the AC voltage applied to the barrier discharge electrodes 2, it is possible to create sample molecular ions sufficient to create target ions of amounts required for a high resolution mass spectrometry.

Both of the sample gas ionized (sample molecular ions) and the sample gas not ionized, flow into the vacuum chamber 30 through a pore of the orifice 3 from the inside of the dielectric container 1 of the ion source 101 as a flow 24 of the sample molecular ions. According to the orifice 3, it is possible to minimize the distance to the mass spectrometry section 102 from the ion source 101, and to minimize a transmission loss of the sample molecular ions. Here, the flow volume per unit time of the sample gas which flows into the vacuum chamber 30 from the ion source 101 is determined by the ultimate pressure of the ion source 101, a conductance (pore size) of the orifice 3, and the degree of vacuum (pressure) of the vacuum chamber 30. Conversely, the flow volume per unit time of the sample gas which flows into the vacuum chamber 30 from the ion source 101 affects a variation of the degree of vacuum (pressure) in the vacuum chamber 30. According to the above descriptions, by adjusting the conductance, it is possible to set the flow volume per unit time of the sample gas which flows into the vacuum chamber 30 from the ion source 101 with high reproducibility, and the degree of vacuum (pressure) in the vacuum chamber 30 with high reproducibility, with respect to the desired ultimate pressure with high reproducibility.

The sample molecular ions included in the sample gas which flow into the vacuum chamber 30 from the ion source 101 are trapped (ion accumulated) in linear ion trap electrodes 31*a*, 31*b*, 31*c*, and 31*d* (see FIG. 1B), by an RF electric field and a DC electric field which are generated by the linear ion trap electrodes 31*a*, 31*b*, 31*c*, and 31*d* constituting a quadrupole, and by a DC electric field which is generated by an in-cap electrode 32 and an end-cap electrode 33. On the other hand, air and the sample gas, which are not ionized and flow into the vacuum chamber 30 from the ion source 101, are not trapped in the linear ion trap electrodes 31*a*, 31*b*, 31*c*, and 31*d*, but evacuated to the outside of the mass spectrometer through the turbomolecular pump 36 and the roughing pump 37 from the vacuum chamber 30, as the gas flow 26 to be evacuated.

In order to transmit efficiently the sample molecular ions, which flow into the vacuum chamber 30, into the linear ion trap electrodes 31*a*, 31*b*, 31*c*, and 31*d*, the sample molecular ions are accelerated in the direction along the linear ion trap electrodes 31*a*, 31*b*, 31*c*, and 31*d*, by applying appropriate bias voltages between the orifice 3 and the in-cap electrode 32, between the in-cap electrode 32 and the linear ion trap electrodes 31*a*, 31*b*, 31*c*, and 31*d*, and between the linear ion trap electrodes 31*a*, 31*b*, 31*c*, and 31*d* and the end-cap electrode 33. For example, if the sample molecular ions to be measured are positive ions, about −5 V is applied to the orifice 3, about −10 V is applied to the in-cap electrode 32 and the end-cap electrode 33, and about −20 V is applied to the linear ion trap electrodes 31*a*, 31*b*, 31*c*, and 31*d* as trap-bias voltages. By applying such bias voltages, it is possible to accumulate efficiently the positive ions to be measured in the linear ion trap electrodes 31*a*, 31*b*, 31*c*, and 31*d*, and to prevent the negative ions not to be measured from entering into the linear ion trap electrodes 31*a*, 31*b*, 31*c*, and 31*d*.

Figure 1B:
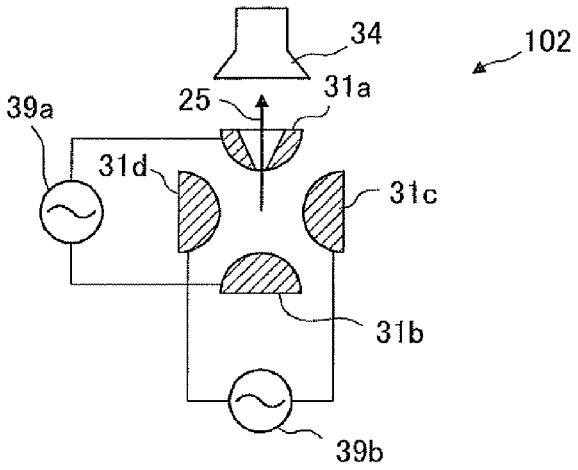
FIG. 1B is a block diagram of a mass spectrometry section of the mass spectrometer according to the first embodiment of the present invention.

FIG. 1B shows a block diagram of a mass spectrometry section 102. Incidentally, FIG. 1B shows a cross-sectional view including the linear ion trap electrodes 31*a*, 31*b*, 31*c*, and 31*d* taken along a plane perpendicular to the direction in which the sample molecular ions and the like are introduced.

The mass spectrometry section 102 includes four rod-shaped electrodes (linear ion trap electrodes) 31*a*, 31*b*, 31*c*, and 31*d*, which are arranged in parallel with one another at equal intervals on a circumference. Two pair of linear ion trap electrodes, i.e., a pair of electrodes 31*a*, 31*b* and a pair of electrodes 31*c*, 31*d*, facing one another across the center of the circumference, are respectively applied with different linear ion trap electrodes AC voltages (trap RF voltages) 39*a*, 39*b*. The trap RF voltage is known to have different optimum values depending upon the sizes of the electrodes and the range of measured mass, and an RF voltage having an amplitude of 5 kV or less and a frequency of about 500 kHz to 5 MHz is typically used. By applying the trap RF voltage, and further by setting a DC voltage difference of several tens of V between the in-cap electrode 32 and the end-cap electrode 33, ions such as sample molecular ions can be trapped (ion accumulated) in a space surrounded by the four linear ion trap electrodes 31*a*, 31*b*, 31*c*, and 31*d*.

In the mass spectrometry 102, the ions such as sample molecular ions, which are ion trapped (ion accumulated), are separated (mass separated) for each different mass. Before the mass separation, it is necessary to reduce the pressure (so-called evacuation wait is necessary) in the mass spectrometry section 102 by evacuating air and sample gas which are not ionized and flow into the vacuum chamber 30 from the ion source 101, to 0.1 Pa or less in which the mass separation of the ions is possible. Total amount of gas flowing into the mass spectrometry section 102 is equivalent to an amount of the sample gas flowing into the ion source 101, and the amount of the sample gas (amount of molecules) is sufficiently small, because the gas in the headspace 21 in the sample container 17 depressurized is introduced for only a short time of about several tens of msec to several hundreds of msec by using the pinch valve 105. Therefore, it is possible to reduce the pressure in the mass spectrometry section 102 in a short time to a pressure of 0.1 Pa or less in which the mass spectrometry is possible, even if capacities of the turbomolecular pump 36 and the roughing pump 37 are small. As a consequence, it is possible to reduce the capacities of the turbomolecular pump 36 and the roughing pump 37, and further reduce the size and weight of the mass spectrometer 100. In addition, since the pressure is reduced in a short time, it is possible to increase the throughput when the mass spectrometry is carried out repeatedly. It is important that the exchange of the measurement sample 19 is not complicated in order to increase the throughput. The exchange of the measurement sample 19 will be described later in detail as an attachment/detachment of the cartridge 8.

When the ions trapped in the mass spectrometry section 102 are subjected to mass separation, the linear ion trap electrode AC voltage (auxiliary AC voltage) 39*a* is applied across the pair of linear ion trap electrodes 31*a* and 31*b* facing each other. Typically, for the auxiliary AC voltage 39*a*, an AC voltage having amplitudes varied continuously in a range of amplitude of 50 V or less at a single frequency of about 5 kHz to 2 MHz (voltage sweep scheme), or an AC voltage having frequencies varied continuously at a constant amplitude (frequency sweep scheme) is used. By applying the auxiliary AC voltage 39*a*, for the ions trapped in the mass spectrometry section 102, ions having values of specific mass numbers divided by charge amounts (mass number/charge amount, m/z value) are continuously mass separated, ejected in the direction of a flow 25 of the mass separated sample molecular ions, converted into electric signals by an ion detector 34, and transmitted to the control circuit 38 so as to be accumulated (stored) therein. Here, the ion detector 34 includes an electron multiplier tube, a multi-channel plate, or a conversion dynode, a scintillator, a photomultiplier, or the like.

Figure 2A:
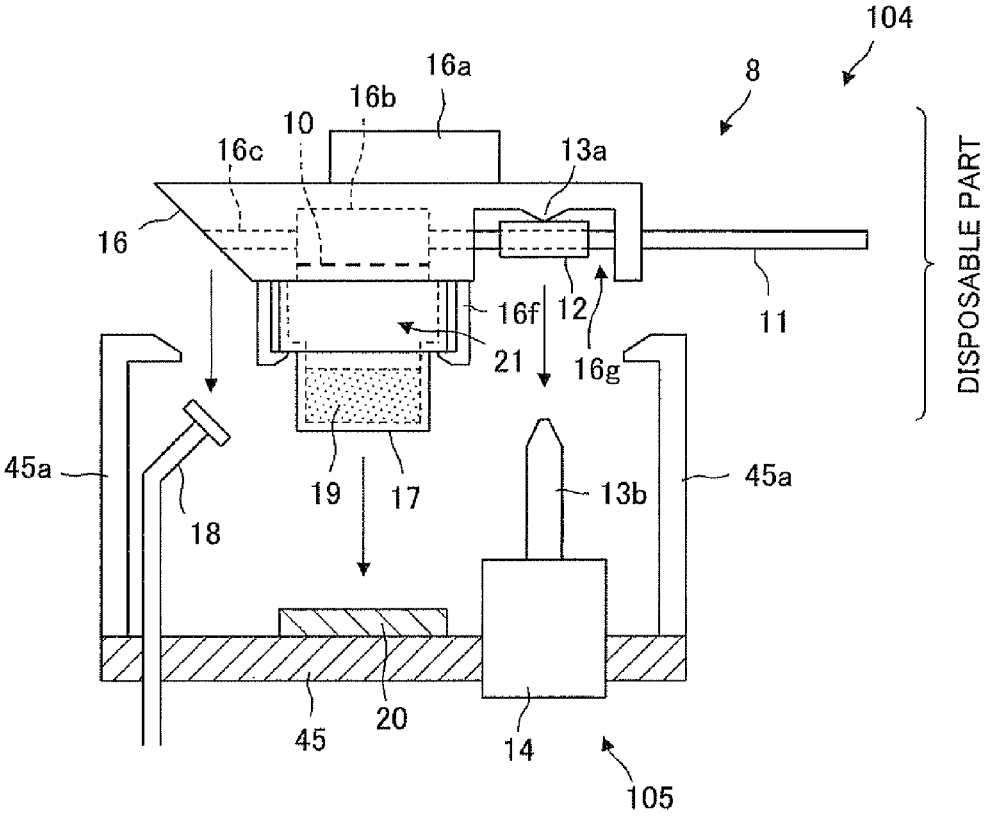
FIG. 2A is a diagram showing a state when attaching a cartridge to a main body of the mass spectrometer.

FIG. 2A shows a state when attaching a cartridge 8 to a main body of the sample introduction section 104 (mass spectrometer 100). The measurement sample 19 is put in the sample container 17. The sample container 17 is secured to the cartridge body (sample container cap) 16 with hooks 16*f*, and capped by the cartridge body (sample container cap) 16. The cartridge body 16 is provided with the gas chamber 16*b* which is a space leading to the headspace 21 of the sample container 17. The through hole 16*c* connected to the pressure reduction pipe 18 and the sample gas pipe 15 connected to the elastic tube 12, are connected to the gas chamber 16*b*. The sample gas pipe 15, the elastic tube 12, and the thin pipe 11 are connected in this order, in series, and in a straight line. The thin pipe 11 and the sample gas pipe 15 are fixedly supported by the cartridge body 16. The elastic tube 12 is supported by the thin pipe 11 and the sample gas pipe 15 which are respectively connected to the both ends thereof. The elastic tube 12 is accommodated in a depression 16*g* which is formed on the cartridge body 16 so as to support the above pipes by extending to the sides of the both ends and the side surfaces of the elastic tube 12, and thereby the elastic tube 12 can be protected. The cartridge 8 is provided with a cartridge handle 16*a* on the cartridge body (sample container cap) 16, and a handling thereof is facilitated.

The filter 10 is provided between the gas chamber 16*b* and the sample container 17, so that a liquid and a solid of the measurement sample 19 do not enter into the pressure reduction pipe 18 and the elastic tube 12. The measurement sample 19 is in contact with the external atmosphere via the filter 10, the gas chamber 16*b*, and the through hole 16*c*, and in contact with the external atmosphere via the filter 10, the gas chamber 16*b*, the sample gas pipe 15, the elastic tube 12, and the thin pipe 11, so that the sample 19 can be prevented from being lost to the external atmosphere from the sample container 17 by natural vaporization. Therefore, before the measurement of the mass spectrometry, it is possible to store a plurality of cartridges 8 which are prepared by mounting each of different measurement samples 19 therein. In addition, the measurement sample 19 in the cartridge 8 which has been measured once can be measured again, because the measurement sample 19 can be stored in the cartridge 8 as it is. Since the cartridge 8 is small, many cartridges 8 can be stored without requiring much space. Since the cartridges 8 are different from one another for each measurement sample 19, it is possible to prevent the carryover by using a new cartridge. If there is a possibility that the measurement sample 19 and/or the sample gas remain in the cartridge 8, i.e., the cartridge body (sample container cap) 16, the sample container 17, the elastic tube 12, and the thin tube 11, and a carryover is caused in the later measurement even if they are washed after the measurement, the cartridge 8 can be disposable. As a consequence, it is considered to be useful for carrying out quickly and fairly the measurements such as a drug inspection in urine.

Figure 2B:
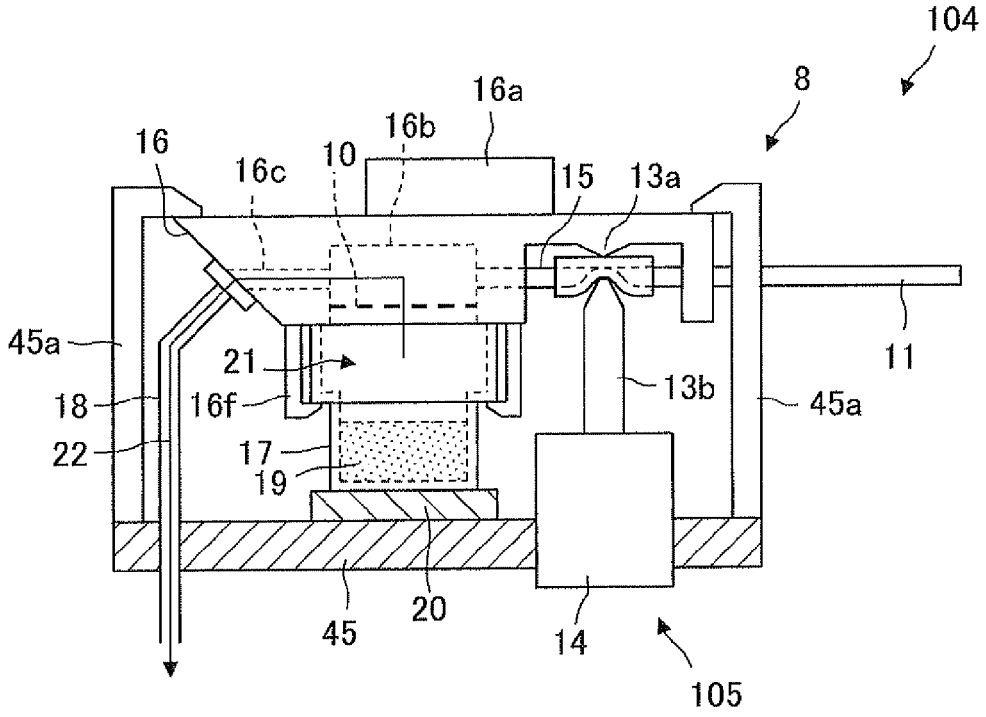
FIG. 2B is a diagram showing a state after attaching the cartridge to the main body of the mass spectrometer.

FIG. 2B shows a state after attaching the cartridge 8 to the main body of the sample introduction section 104 (mass spectrometer 100). As shown in FIG. 2A and FIG. 2B, the cartridge 8 can be secured to the main body of the sample introduction section 104 (mass spectrometer 100) with hooks 45*a*. As shown in FIG. 2B, after attaching the cartridge 8, the elastic tube 12 is in a closed state by being sandwiched between the fixed weir 13*a* and the moving weir 13*b*. In other words, the pinch valve 105 is a normally closed type. In addition, the through hole 16*c* is connected to the pressure reduction pipe 18, and the headspace 21 in the sample container 17 is depressurized. Further, the sample container 17 is heated by contact with the heater 20. Accordingly, the measurement sample 19 is vaporized, and the generated sample gas is evacuated to the side of the pressure reduction pipe 18 as a sample gas flow 22 to be evacuated.

Figure 2C:
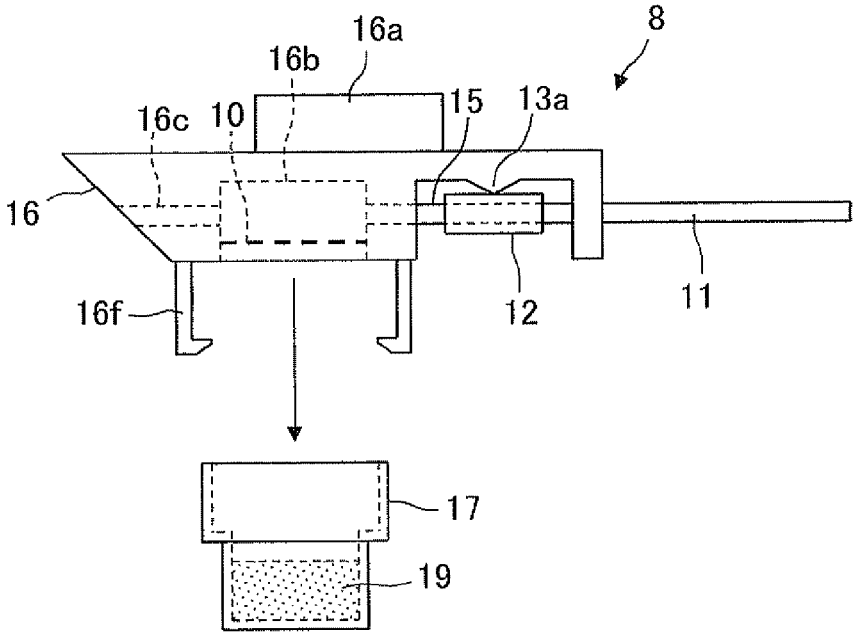
FIG. 2C is a diagram showing a state when a sample container is detached from the cartridge.

FIG. 2C shows a state after the sample container 17 is detached from the cartridge 8. When the cartridge 8 is not attached to the sample introduction section 104 (mass spectrometer 100), an operator can easily approach the hooks 16*f* and detach the sample container 17 from the cartridge 8 by removing the hooks 16*f* from the sample container 17. And the operator can put the measurement sample into the sample container 17. The sample container 17 can be attached to the cartridge body (sample container cap) 16 by the hooks 16*f*. The sample container 17 is detachable from the cartridge 8 when the cartridge 8 is in the detached state from the sample introduction section 104.

Figure 3A:
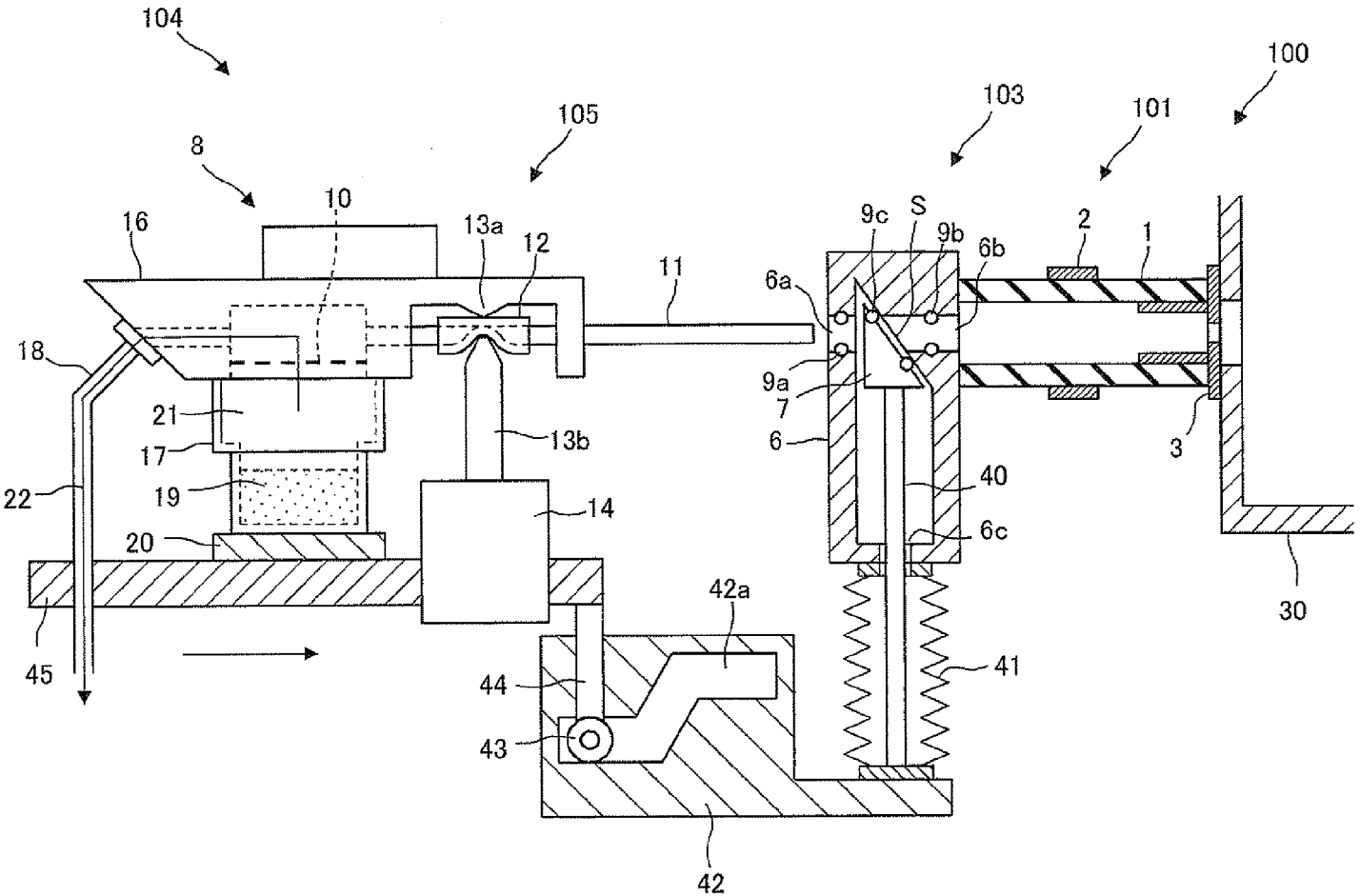
FIG. 3A is a diagram (No. 1) showing a state for inserting a thin pipe into an ion source.

FIG. 3A shows a state when the cartridge 8 is attached to the main body of the sample introduction section 104 (mass spectrometer 100). As shown in FIG. 3A, when the cartridge 8 is in the attachment state, the thin pipe 11 is not inserted into the dielectric container 1 of the ion source 101. The insertion hole 6*b* which is communicated with the dielectric container 1 is closed with the slide valve valving element 7, and the slide valve 103 is closed. Thus, the dielectric container 1 is maintained in a reduced pressure. For inserting the thin pipe 11 into the dielectric container 1, the sample introduction section base (driving slider, rectilinear motion driving member) 45 is slid, so that the thin pipe 11 moves toward the dielectric container 1 (the outside insertion hole 6*a* of the slide valve container 6) (forward movement). According to the slide of the sample introduction section base (driving slider, rectilinear motion driving member) 45, the guide roller (follower) 43 also moves, however, the movement is within a stationary range in the cam slot 42*a* and does not move the grooved cam (driven slider, linear motion driven member) 42. Therefore, by the movement within the stationary range, the slide valve 103 is not opened but the closed state is maintained. The stationary state continues until a distance between the thin pipe 11 and the slide valve valving element 7 (slide valve 103) is shortened to reach a distance D1 (first predetermined distance, see FIG. 3B) or a distance between the thin pipe 11 and the insertion hole 6*b* reaches a distance D2 (second predetermined distance, see FIG. 3B).

Figure 3B:
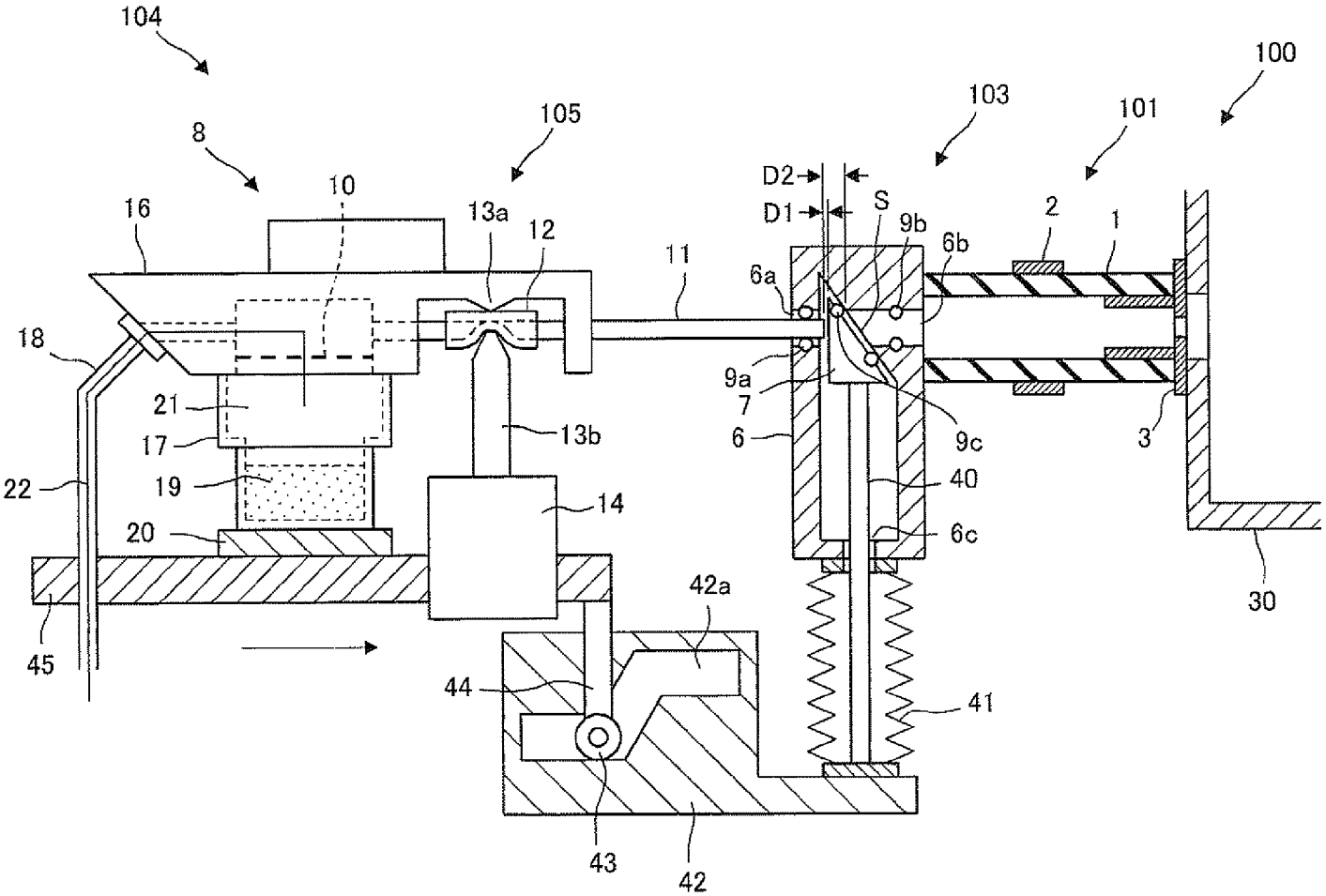
FIG. 3B is a diagram (No. 2) showing a state for inserting the thin pipe into the ion source.
Figure 3C:
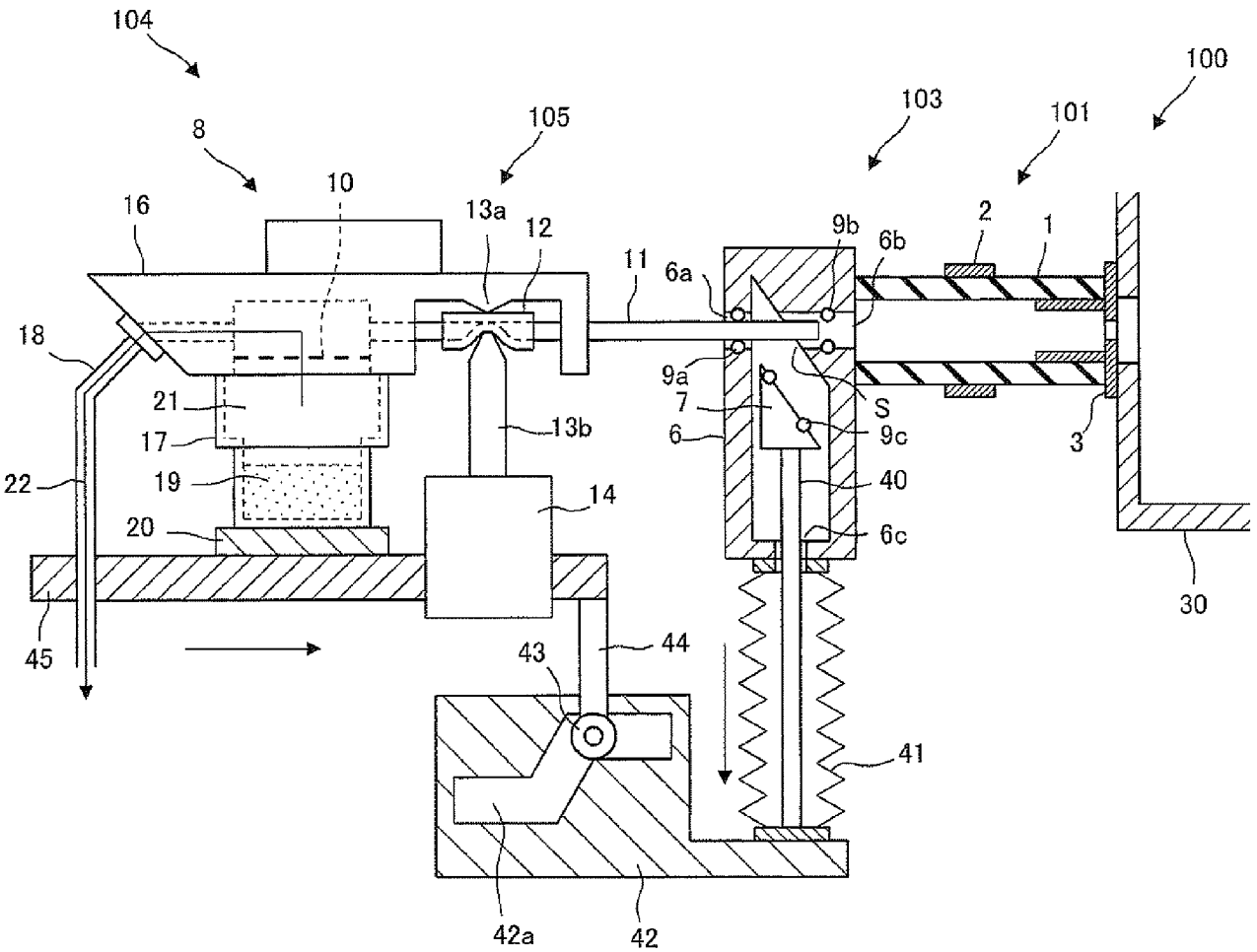
FIG. 3C is a diagram (No. 3) showing a state for inserting the thin pipe into the ion source.

When the sample introduction section base 45 is slid (moved forward), the sample introduction section 104 is in a state shown in FIG. 3B. One end of the thin pipe 11 is inserted into the outside insertion hole 6*a*, and into the first O-ring 9*a* therein. A gap between the thin pipe 11 and the outside insertion hole 6*a* is sealed by the first O-ring 9*a*. Since the other end of the thin pipe 11 is closed by closing the elastic tube 12, an inner space of the thin pipe 11 and the slide valve container 6 is a sealed space including an inner space of the vacuum bellows 41. The slide valve 103 is maintained in the closed state without opening the valve, and the dielectric container 1 is maintained in a reduced pressure. The guide roller (follower) 43 moves to an end portion of the stationary range. Since the thin pipe 11 proceeds toward the slide valve valving element 7 (slide valve 103), it seems that the thin pipe 11 collides with the slide valve valving element 7. However, when the distance between the thin pipe 11 and the slide valve valving element 7 (slide valve 103) is shortened to the distance D1 (first predetermined distance) or the distance between the thin pipe 11 and the insertion hole 6*b* is shortened to the distance D2 (second predetermined distance), the slide valve valving element 7 (slide valve 103) starts opening the valve to be away from the insertion hole 6*b* as shown in FIG. 3C, so that the thin pipe 11 and the slide valve valving element 7 do not collide with each other. When the distance between the thin pipe 11 and the slide valve valving element 7 is shortened to be less than the distance D1, by the rightward movement of the sample introduction section base 45 (guide roller 43) in FIGS. 3B and 3C, the guide roller 43 is going to move rightward in the cam slot 42*a*, and thereby pushes down the grooved cam (driven slider, linear motion driven member) 42. As a consequence, the valving element shaft 40 attached to the grooved cam 42 is lowered, and the slide valve valving element 7 attached to the valving element shaft 40 is lowered. The thin pipe 11 and the slide valve valving element 7 do not interfere with each other, and the slide valve 103 can be opened. When the thin pipe 11 approaches the slide valve valving element 7 (slide valve 103) and the distance between the thin pipe 11 and the slide valve valving element 7 is shortened to the distance D1, the slide valve valving element 7 starts opening (descending). The thin pipe 11 becomes capable of proceeding by passing through the side of the slide valve valving element 7.

When the slide valve valving element 7 is lowered, the slide valve 103 is in the open state, and it seems that the dielectric container 1 cannot be maintained in a reduced pressure. However, when the distance between the thin pipe 11 and the slide valve valving element 7 (slide valve 103) is shortened to the distance D1 or the distance between the thin pipe 11 and the insertion hole 6*b* is shortened to the distance D2, the thin pipe 11 is inserted into the first O-ring 9*a* of the outside insertion hole 6*a*, and thin pipe 11 and the slide valve container 6 are connected with each other while sealing the gap between the outside insertion hole 6*a* and the thin pipe 11. As described above, since the inner space of the thin pipe 11, the slide valve container 6, and the vacuum bellows 41 is a sealed space into which the outside air does not enter, only a limited amount of air flows into the dielectric container 1, and it is possible to maintain the reduced pressure in the dielectric container 1. In addition, unless the thin pipe 11 is close to the slide valve valving element 7, the slide valve valving element 7 does not open. Therefore, the distance from the thin pipe 11, which is close to the slide valve valving element 7, to the dielectric container 1 (insertion hole 6*b*, second O-ring 9*b*) is very short. Since a time required for moving the thin pipe 11 by the very short distance is also very short, a time the insertion hole 6*b* is not sealed by the slide valve valving element 7 or the thin pipe 11 is also very short, and thereby the decrease of the vacuum degree (the increase of the pressure) in the dielectric container 1 is very small. Therefore, the reduced pressure in the dielectric pressure 1 can be maintained, even if the outside insertion hole 6*a* is omitted.

Figure 3D:
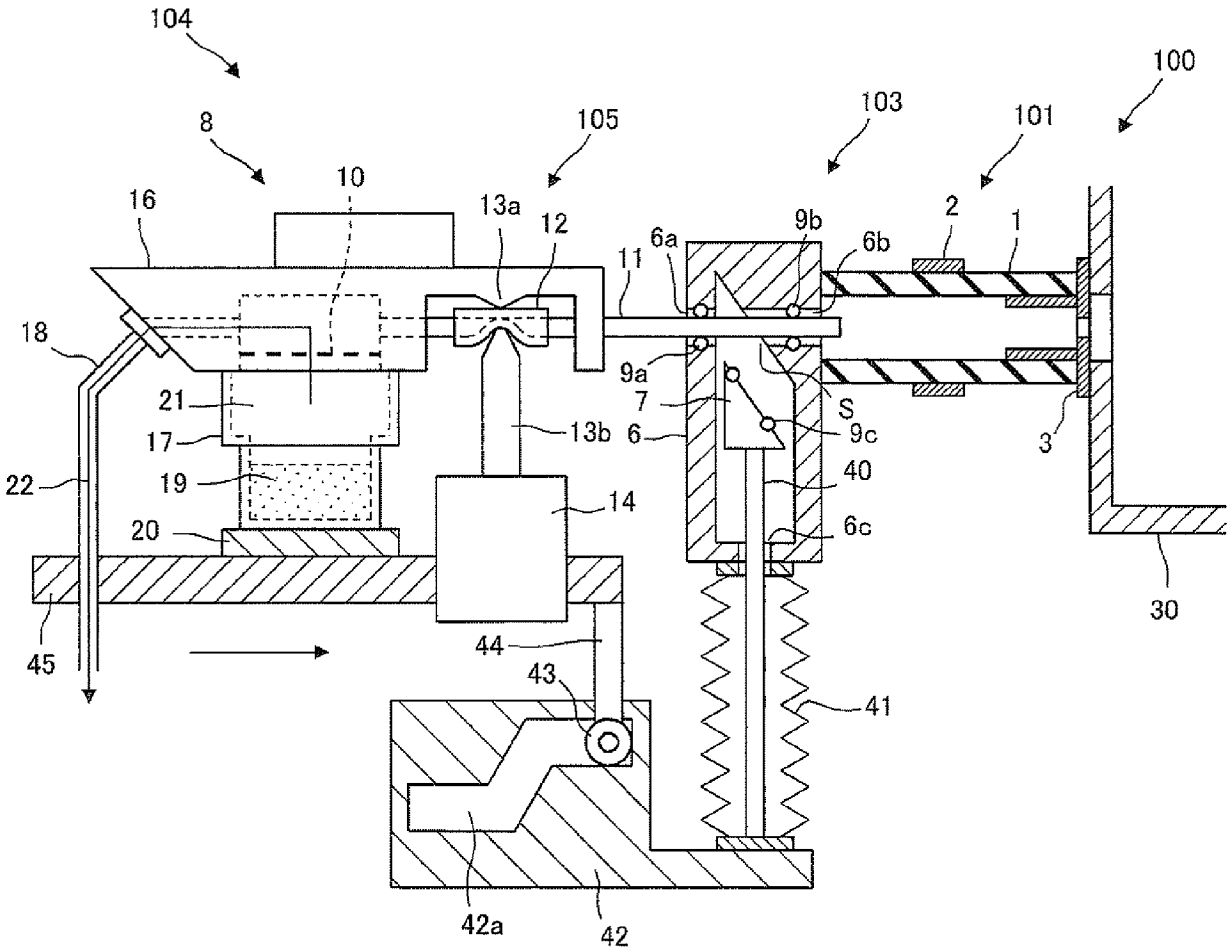
FIG. 3D is a diagram (No. 4) showing a state for inserting the thin pipe into the ion source.

When the sample introduction section base 45 is slid (moved forward), the sample introduction section 104 is in a state shown in FIG. 3D. In order to insert the thin pipe 11 into the dielectric container 1, when the sample introduction section base (driving slider, rectilinear motion driving member) 45 is slid and the thin pipe 11 moves toward the dielectric container 1 (the insertion hole 6*b* of the slide valve 6), the thin pipe 11 is inserted into the dielectric container 1 of the ion source 101 as shown in FIG. 3D. One end of the thin pipe 11 is inserted into the insertion hole 6*b*, and inserted into the second O-ring 9*b* therein. A gap between the thin pipe 11 and the insertion hole 6*b* is sealed by the second O-ring 9*b*. Since the other end of the thin pipe 11 is closed by closing the elastic tube 12, an inner space of the thin pipe 11 and the dielectric container 1 is a sealed space into which the outside air does not enter. Thus, the dielectric container 1 is maintained in a reduced pressure. In addition, the dielectric container 1 is disconnected with the inner space of the slide valve container 6 and the vacuum bellows 41. According to the slide of the sample introduction section base (driving slider, rectilinear motion driving member) 45, the guide roller (follower) 43 also moves, however, the movement is within a stationary range in the cam slot 42*a* and does not move the grooved cam (driven slider, linear motion driven member) 42. In the stationary range, it is possible to stop the movement of the slide valve valving element 7 while keeping the slide valve valving element 7 in the valve open state. Therefore, it is possible to reduce the moving distance of the slide valve valving element 7, regardless of the moving distance of the sample introduction section 104 for the insertion of the thin pipe 11, thereby designing the mass spectrometer so that a volume of an inner space of the vacuum bellows 41 and the slide valve container 6, which accommodates the slide valve valving element 7 and the valving element shaft 40, becomes small. Then, it is possible to further suppress the decrease of the vacuum degree (the increase of the pressure) in the dielectric container 1. As described above, the insertion of the thin pipe 11 into the dielectric container 1 is completed.

Various operations for inserting the thin pipe 11 into the dielectric container 1 described above with reference to FIGS. 3A to 3D are reversible, and it is possible to remove the thin pipe 11 from the dielectric container 1 by the operation (backward movement) reverse to the operation for the insertion (forward movement). For example, the guide roller (follower) 43 goes back in the cam slot 42*a* (backward path) in the direction reverse to the forward path on which it proceeds when inserting the thin pipe 11, when removing the thin pipe 11 (backward movement). Specifically, as shown in a change from FIG. 3D to FIG. 3C, the thin pipe 11 is removed from the dielectric container 1, next from the insertion hole 6*b*, in particular, from the second O-ring 9*b*. Next, as shown in a change from FIG. 3C to FIG. 3B, the thin pipe 11 becomes away from the insertion hole 6*b*. The slide valve valving element 7 is elevated to start closing the valve, the thin pipe 11 is removed from the insertion hole 6*b*, and the slide valve valving element 7 (slide valve 103) completes the valve closing as shown in FIG. 3B, when the distance between the thin pipe 11 and the insertion hole 6*b* is extended to the distance D2. At this time, the thin pipe 11 is away from the slide valve valving element 7 (slide valve 103) by the distance D1, and the thin pipe 11 and the slide valve valving element 7 (slide valve 103) do not collide with each other. When the distance between the thin pipe 11 and the insertion hole 6*b* is extended to the distance D2, the thin pipe 11 is still inserted into the first O-ring 9*a* of the outside insertion hole 6*a*, and the thin pipe 11 and the slide valve container 6 is connected with each other while sealing the gap between the outside insertion hole 6*a* and the thin pipe 11. Therefore, the inner space of the thin pipe 11, the slide valve container 6, and the vacuum bellows 41 is the sealed space into which the outside air does not enter as described above, and thereby the reduced pressure in the dielectric container 1 can be maintained, even if the limited amount of air flows into the dielectric container 1.

A perpendicular line of the opening surface S of the insertion hole 6*b* is inclined with respect to the central axis of the insertion hole 6*b*, and not in the relationship of parallel or perpendicular. A surface of the slide valve valving element 7, which closes the opening surface S, is arranged in parallel with the opening surface S when in the valve open state and the valve closed state, and moves while maintaining the relationship of parallel when opening and closing the valve. The moving direction of the slide valve valving element 7 when opening and closing the valve is a longitudinal direction of the valving element shaft 40, and not in parallel with the opening surface S. Therefore, if the slide valve valving element 7 is elevated to be close to the opening surface S when closing the valve, the surface of the slide valve valving element 7, which closes the opening surface S, comes into contact with a wall surface around the opening surface S. Since the ion source 101 communicated with the insertion hole 6*b* is differentially pumped, at the moment when the slide valve valving element 7 comes into contact with the wall surface around the opening surface S to close the opening surface S, the pressure in the insertion hole 6*b* is reduced, and the slide valve valving element 7 is adsorbed on the wall surface around the opening surface S. As a consequence, the slide valve valving element 7 can be closed reliably.

Next, as shown in a change from the FIG. 3B to FIG. 3A, the thin pipe 11 is removed from the outside insertion hole 6*a* (first O-ring 9*a*). Finally, as shown in a change from the FIG. 3A to FIG. 2A, the cartridge 8 is removed. In this manner, the detachment of the cartridge 8 can be carried out while maintaining the dielectric container 1 in a reduced pressure. Since the cartridge 8 can be removed, the cartridge 8 can be a disposable part. In this manner, by preparing a plurality of cartridges 8 in advance, the measurements can be performed with exchanging the cartridges 8, and thereby the throughput of the measurement can be enhanced. Since the cartridge 8 is exchanged as a disposable part, the carryover can be prevented. In addition, the insertion and removal of the thin pipe 11 in the attachment state of the cartridge 8 can be easily carried out by simply sliding the sample introduction section base 45 as described above. This means that the movement of the slide valve valving element 7 and the like is conjunction with the slide (movement) of the sample introduction section base 45 by the cam slot 42*a* and the like, and does not cause a timing difference for the slide (movement) of the sample introduction section base 45. Therefore, a sequence of operations of the insertion and removal of the thin pipe 11 can be reliably carried out by a simple movement of sliding the sample introduction section base 45.

Figure 4A:
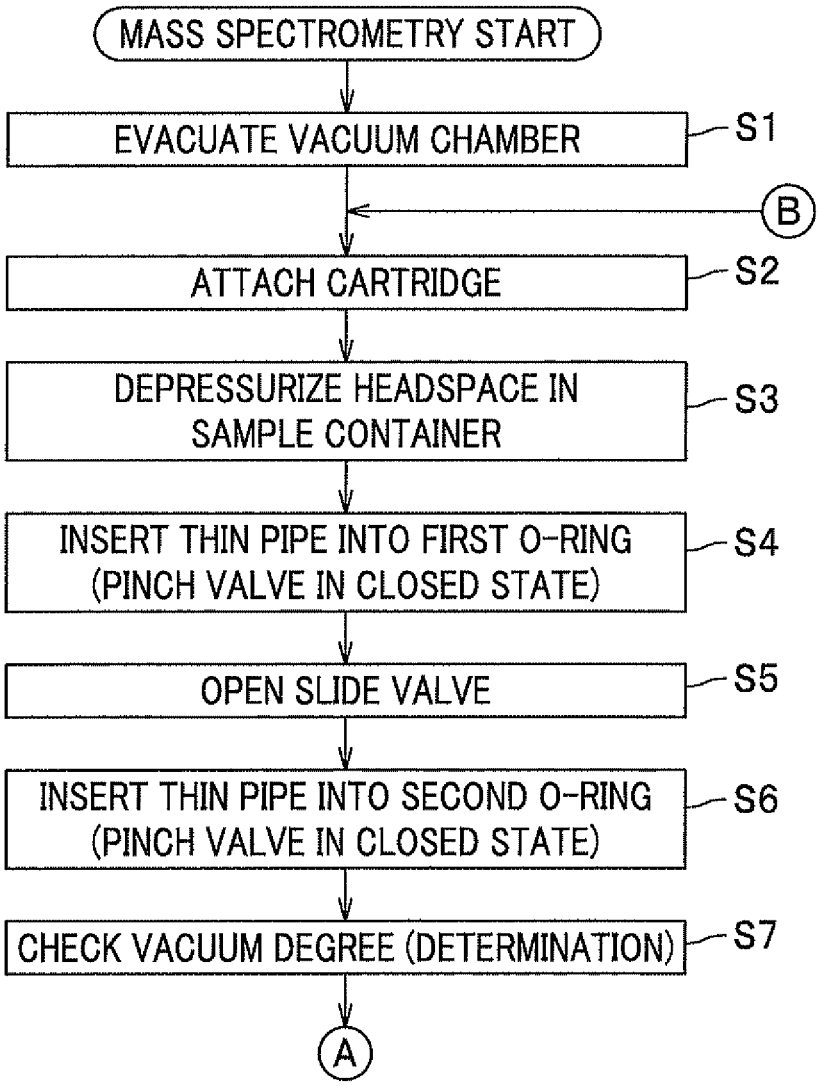
FIG. 4A is a flow chart (No. 1) of a mass spectrometry carried out in the mass spectrometer according to the first embodiment of the present invention.
Figure 4B:
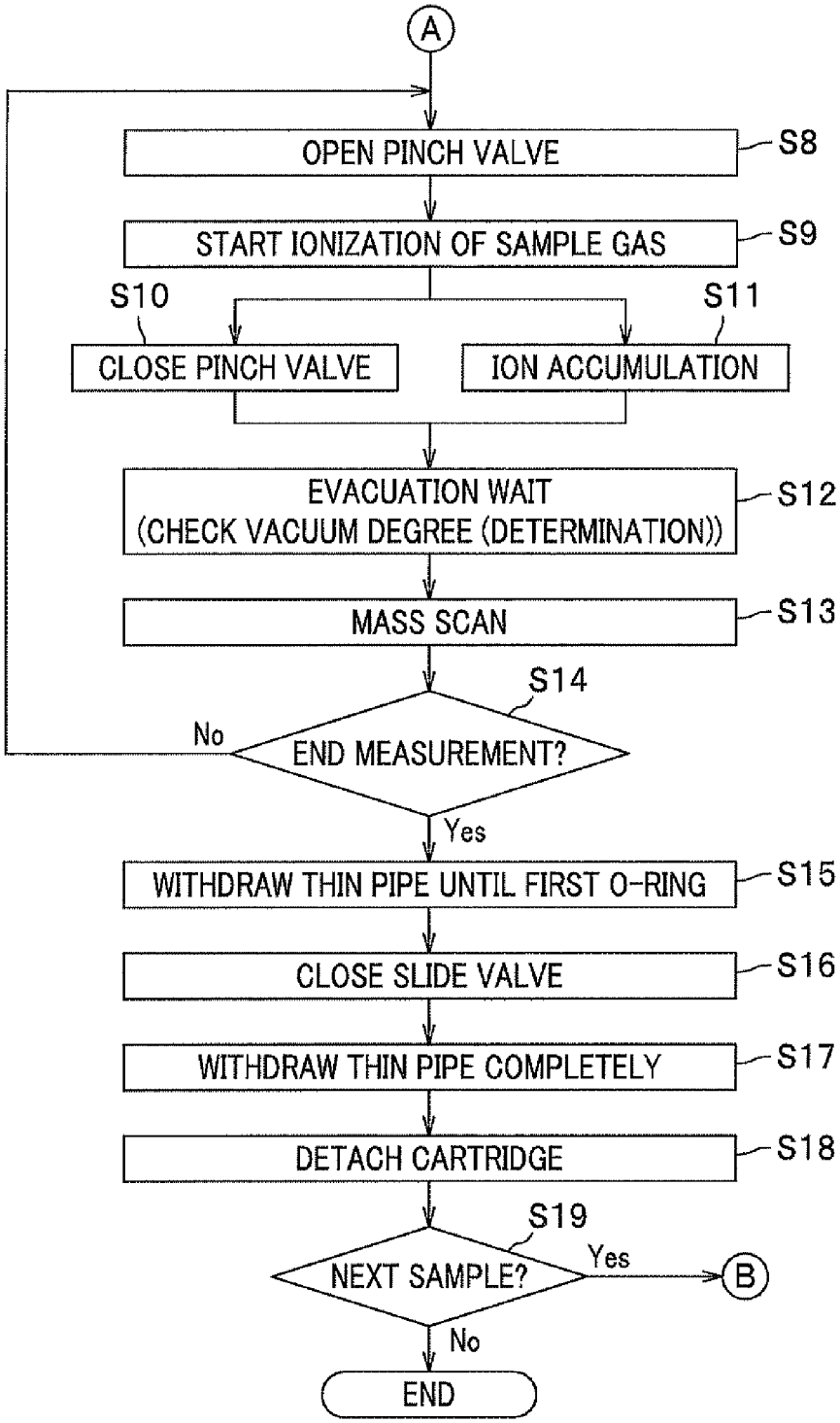
FIG. 4B is a flow chart (No. 2) of the mass spectrometry carried out in the mass spectrometer according to the first embodiment of the present invention.

FIGS. 4A and 4B show flow charts of a mass spectrometry carried out in the mass spectrometer 100 according to the first embodiment of the present invention. First, in Step S1 in FIG. 4A, the mass spectrometer 100 (control circuit 38) is activated when the power of the mass spectrometer 100 is turned on by an operator. The control circuit 38 automatically evacuates the vacuum chamber 30 by the control using the turbomolecular pump 36, the roughing pump 37, the vacuum gauge 35, and the like. The control circuit 38 determines whether or not the vacuum degree in the vacuum chamber 30 reaches a predetermined vacuum degree by monitoring the vacuum degree (variation) in the vacuum chamber 30 by the vacuum gauge 35. After determining that the vacuum chamber 30 reaches the predetermined vacuum degree, the process proceeds to Step S2.

In Step S2, as shown in FIG. 2C, the operator removes the sample container 17 from the cartridge 8 and puts the measurement sample 19 in the sample container 17. The operator attaches the sample container 17 to the cartridge 8. As shown in a change from FIG. 2A to FIG. 2B, the operator attaches the cartridge 8 to the main body of the sample introduction section 104. As shown in FIG. 2B, the elastic tube 12 is squashed and closed by the pinch valve 105 (fixed weir 13*a* and moving weir 13*b*), and the pinch valve 105 becomes in the valve closed state. The valve closed state of the pinch valve 105 continues until the end of Step S7. In addition, the pressure reduction pipe (pressure reduction unit) 18 is connected to the sample container 17 via the through hole 16*c*.

In Step S3, the pressure reduction pipe (pressure reduction unit) 18 depressurizes the headspace 21 in the sample container 17.

In Step S4, as shown in a change from FIG. 3A to FIG. 3B, the operator moves the sample introduction section base (driving slider, rectilinear motion driving member) 45 together with the sample introduction section 104 in the direction of the slide valve 103. The movement by the operator continues until the end of Step S6. As shown in FIG. 3B, the thin pipe 11 is inserted to penetrate the first O-ring 9*a* in the outside insertion hole 6*a*. During this period, the pinch valve 105 and the slide valve 103 stay in the closed state.

In Step S5, as shown in a change from FIG. 3B to FIG. 3C, the operator further moves the sample introduction section base (driving slider, rectilinear motion driving member) 45 together with the sample introduction section 104 in the direction of the slide valve 103. The slide valve valving element 7 is lowered and the slide valve 103 becomes in the valve open state. The insertion hole 6*b* communicating with the inside of the dielectric container 1 opens.

In Step S6, as shown in a change from FIG. 3C to FIG. 3D, the operator further moves the sample introduction section base (driving slider, rectilinear motion driving member) 45 together with the sample introduction section 104 in the direction of the slide valve 103. As shown in FIG. 3D, the thin pipe 11 passes through the second O-ring 9*b* in the insertion hole 6*b* and is inserted into the dielectric container 1. The control circuit 38 determines whether or not the sample introduction section 104 is moved to a predetermined position at which measurement is possible. If the control circuit 38 determines that the sample introduction section 104 is not moved to the predetermined position, the control circuit 38 prompts the operator to further move the sample introduction section base 45, and if the control circuit 38 determines that the sample introduction section 104 is moved to the predetermined position, the control circuit 38 prompts the operator to stop the movement.

In Step S7, the control circuit 38 monitors the vacuum degree (variation) in the vacuum chamber 30 by the vacuum gauge 35, and determines whether or not the vacuum degree, which has been temporarily reduced by Step S5, is restored and increased to the predetermined value or more. If the vacuum degree in the vacuum chamber 30 is equal to or more than the predetermined value, the process proceeds to Step S8. If the vacuum degree in the vacuum chamber 30 is less than the predetermined value, the process does not proceed to Step S8. Since it is considered that there is a defect in the insertion of the thin pipe 11, the operator performs the insertion of the thin pipe 11 again by returning to Step S4 or by returning to Step S2.

Figure 5A:
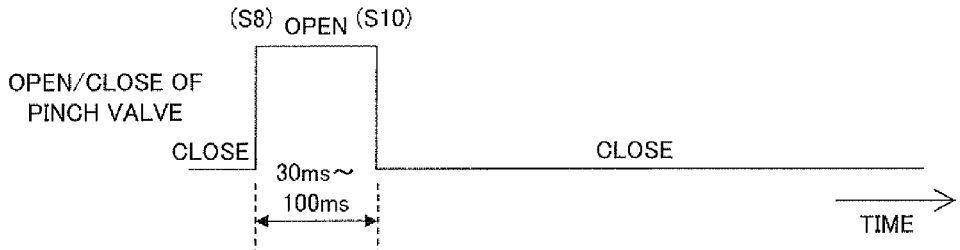
FIGS. 5A, 5B, and 5C are graphs showing a variation of a pressure in the ion source (dielectric container) (FIG. 5B) and a variation of a pressure in the mass spectrometry section (vacuum chamber) (FIG. 5C) associated with open/close of a pinch valve (FIG. 5A).
Figure 5B:
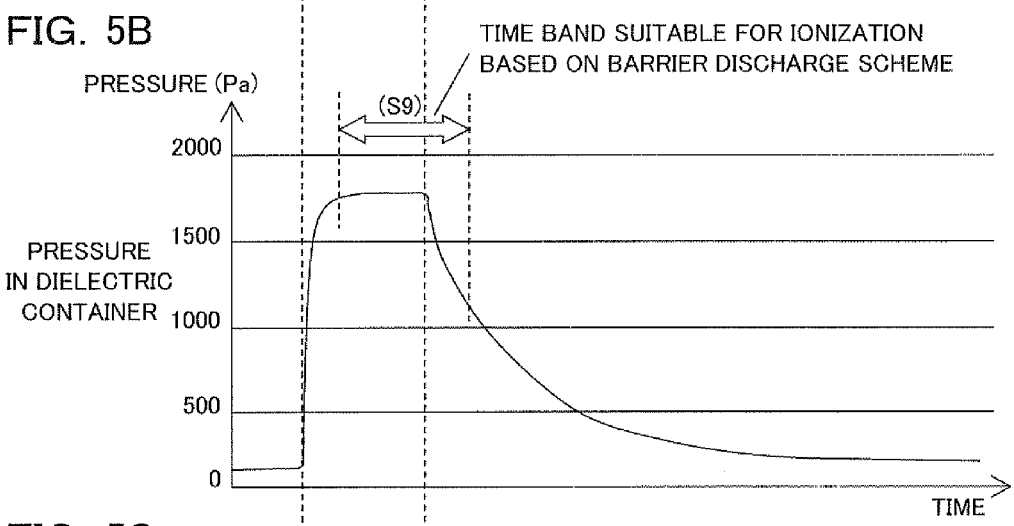
Figure 5C:
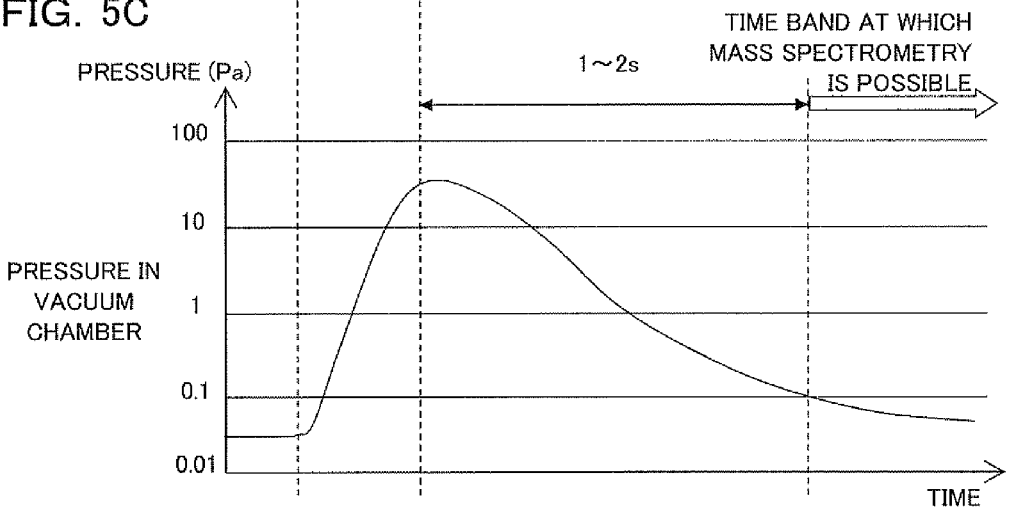

In Step S8 in FIG. 4B, the control circuit 38 opens the pinch valve 105 (elastic tube 12) and introduces the sample gas into the ion source 101 (the inside of the dielectric container 1) in order to start the measurement. FIGS. 5A, 5B, and 5C show a variation of a pressure in the ion source (the inside of the dielectric container) (FIG. 5B) and a variation of a pressure in the vacuum chamber (FIG. 5C) associated with open/close of the pinch valve 105 (FIG. 5A). As shown in FIGS. 5A and 5B, when the pinch valve 105 is opened, the pressure in the dielectric container 1 increases to reach a pressure (for example, 100 to 10,000 Pa, preferably 1000 to 2500 Pa, and 1800 Pa in an example in FIG. 5B) suitable for the ionization based on the barrier discharge scheme in a case where the atmosphere is used for the discharge gas, in several tens msec with high reproducibility. As shown in FIG. 5C, the pressure in the vacuum chamber 30 is also increased gradually to reach about 30 to 100 Pa in conjunction with the pressure increase in the dielectric container 1 by the differential pumping. In Step S9, the control circuit 38 generates the barrier discharge and starts the ionization of the sample gas in the dielectric container 1. By starting and terminating the barrier discharge in synchronization with the variation of the pressure in the dielectric container 1, the optimum ionization is achieved. When the pinch valve 105 is opened for a short time of 30 msec to 100 msec as shown in FIG. 5A, the pressure in the dielectric container 1 comes into the pressure band suitable for the ionization based on the barrier discharge scheme, i.e., 100 to 10,000 Pa, preferably 1000 to 2500 Pa as shown in FIG. 5B. While the pressure in the dielectric container 1 is in this pressure band, it is a time band (50 msec to 1 sec) suitable for the ionization based on the barrier discharge scheme, and the barrier discharge can be easily generated if it is in this time band. It should be noted that the time band suitable for the ionization based on the barrier discharge scheme is longer than the time (ionization time) required for the ionization of reactant ions necessary to ensure sufficient sample molecular ions in the mass spectrometry. Therefore, the ionization time can be set arbitrarily if it is in this time band. For example, the ionization time may be started at the same time as the opening of the pinch valve 105, or set across the closing time of the pinch valve 105, or ended at the same time as the closing of the pinch valve 105. The control circuit 38 is adapted to generate the barrier discharge in the set ionization time. The barrier discharge is generated in the barrier discharge region by applying AC voltage of several kV at several MHz from the barrier discharge AC power supply 4 to the two barrier discharge electrodes 2 which are disposed on the outside of the dielectric container 1. Water ($H_2O$) and oxygen molecules ($O_2$) in the atmosphere passing through the barrier discharge region 5 are changed to the reactant ions such as $H_2O^+$ and $O_2^-$ by the barrier discharge and move to the mass spectrometry section 102.

In Step S10, as shown in FIG. 5A, the control circuit 38 closes the pinch valve 105 after a predetermined time (30 msec to 100 msec) has elapsed from the opening of the pinch valve 105 in Step S8.

In Step S11, the control circuit 38 accumulates ions such as the sample gas ionized in Step S9, in the mass spectrometry section 102. Step S11 is started in conjunction with the start of the ionization in Step S9. As shown in FIGS. 5A and 5B, the end of Step S11 and the end of ionization in Step S9 are after the valve closing of the pinch valve 105 in Step S10.

In Step S12, the control circuit 38 waits for 1 to 2 sec from the end of Step S10 (the valve closing of the pinch valve 105) until the pressure in the vacuum chamber 30 which houses the mass spectrometry section 102 is sufficiently reduced. When the pinch valve 105 is closed in Step S10, the pressure in the dielectric container 1 (FIG. 5B) and the pressure in the vacuum chamber 30 (FIG. 5C) are gradually reduced. The pressure in the vacuum chamber 30 (FIG. 5C) reaches a pressure (0.1 Pa or less) at which mass spectrometry is possible in 1 to 2 sec after the closing of the pinch valve 105. Thus, by waiting for 1 to 2 sec, the mass spectrometry section 102 becomes in a state (pressure) at which mass spectrometry is possible. Specifically, the control circuit 38 monitors the vacuum degree (pressure) in the vacuum chamber 30 by the vacuum gauge 35, and determines whether or not the pressure in the vacuum chamber 30 reaches a predetermined pressure (0.1 Pa or less) at which mass spectrometry is possible. If the control circuit 38 determines that the pressure in the vacuum chamber 30 does not reach the predetermined pressure, the control circuit 38 performs the determination repeatedly without proceeding to Step S13. If the control circuit 38 determines that the pressure in the vacuum chamber 30 reaches the predetermined pressure, the process proceeds to Step S13.

In Step S13, the control circuit 38 performs the mass spectrometry (mass scan). The control circuit 38 performs the ion selection, the ion dissociation, and the mass separation, and stores the measurement results.

In Step S14, the control circuit 38 determines whether or not the control circuit 38 ends the measurement of the same measurement sample 19 on the basis of the input or the like from the operator. If the control circuit 38 does not end the measurement of the same measurement sample 19 but continues another measurement of the same measurement sample 19 ("No" in Step S14), the control circuit 38 performs the measurement again by returning to Step S8. In this manner, the control circuit 38 can perform the mass spectrometry of the measurement sample 19 repeatedly. If the control circuit 38 ends the measurement of the same measurement sample 19 ("Yes" in Step S14), the process proceeds to Step S15.

In Step S15, as shown in changes from FIG. 3D to FIG. 3C and further to FIG. 3B, the operator moves the sample introduction section base (driving slider, rectilinear motion driving member) 45 together with the sample introduction section 104 in the direction away from the slide valve 103. Note that the movement by the operator continues until the end of Step S17. As shown in FIG. 3C, the thin pipe 11 is withdrawn and removed from the inside of the dielectric container 1, and further from the second O-ring 9*b* in the insertion hole 6*b*. As shown in a change from FIG. 3C to FIG. 3B, the thin pipe 11 is further withdrawn until a tip end thereof is at the first O-ring 9*a* in the outside insertion hole 6*a*. The thin pipe 11 is inserted to pass through the first O-ring 9*a* in the outside insertion hole 6*a*, and the outside insertion hole 6*a* remains sealed by the thin pipe 11 and the first O-ring 9*a*.

In Step S16, in conjunction with the movement of the sample introduction section base 45 shown in a change from FIG. 3C to FIG. 3B, the slide valve valving element 7 is elevated and the slide valve 103 becomes in the valve closed state. The insertion hole 6*b* communicated with the inside of the dielectric container 1 is closed by the slide valve 103.

In Step S17, as shown in a change from FIG. 3B to FIG. 3A, the operator moves the sample introduction section base (driving slider, rectilinear motion driving member) 45 together with the sample introduction section 104 in the direction away from the slide valve 103. The thin pipe 11 is removed from the first O-ring 9*a* in the outside insertion hole 6*a*. The thin pipe 11 is withdrawn completely from the slide valve container 6.

In Step S18, as shown in a change from FIG. 3A to FIG. 2A, the operator detaches the cartridge 8 from the main body of the sample introduction section 104.

In Step S19, the operator determines whether or not there is a measurement sample 19 to be measured next. If there is a next measurement sample 19 ("Yes" in Step S19), the process returns to Step S2, and if there is not a next measurement sample 19 ("No" in Step S19), the flow of the mass spectrometry ends.

FIGS. 6A to 6J show open/close of the pinch valve 105 (FIG. 6A), a pressure of the barrier discharge region 5 (the inside of the dielectric chamber 1) (FIG. 6B), a pressure of the mass spectrometry section 102 (the inside of the vacuum chamber 30) (FIG. 6C), the barrier discharge electrode (2) AC voltage (FIG. 6D), the orifice (3) DC voltage (FIG. 6E), the in-cap electrode (32)/end-cap electrode (33) DC voltage (FIG. 6F), the trap-bias DC voltage (FIG. 6G), the trap RF voltage (FIG. 6H), the auxiliary AC voltage (FIG. 6I), and ON/OFF of the ion detector 34 (FIG. 6J), in association with a sequence (ion accumulation and evacuation wait—ion selection—ion dissociation—mass scan (mass separation)) of the mass spectrometry (voltage sweep scheme) in the mass spectrometry section 102. As shown in FIGS. 6A to 6J, the sequence of the mass spectrometry (voltage sweep scheme) includes four steps of ion accumulation and evacuation wait, ion selection, ion dissociation, and mass separation. Incidentally, the ion accumulation step and the evacuation wait step are integrally counted as one step because they proceed simultaneously and overlap with each other in time. However, the two steps will be described separately hereinafter, because events taking place are separable and may be performed at different times sequentially.

(Ion Accumulation Step)

First, as shown in FIG. 6A, the pinch valve 105 (see FIG. 1A) is opened. Then, as shown in FIGS. 6B and 6C, the pressure in the barrier discharge region 5 (the inside of the dielectric container 1) and the pressure in the mass spectrometry section 102 rise. As shown in FIGS. 6B and 6D, in accordance with a timing when the pressure in the barrier discharge region 5 (dielectric container 1) rises up to an appropriate value, a pulse voltage or AC voltage of several kV at several MHz is applied to the barrier discharge electrodes 2 from the barrier discharge AC power supply 4, thereby generating the barrier discharge. Ions generated in the barrier discharge region 5 is carried in the direction of the flow 24 of the sample molecular ions by applying appropriate DC voltages (for example, when the sample molecular ions to be measured are positive ions, −5 V as the orifice (3) DC voltage, −10 V as the in-cap electrode (32)/end-cap electrode (33) DC voltage, and −20 V as the trap-bias DC voltage) respectively to a viscous flow of the sample gas, the orifice 3, the in-cap electrode 32, the linear ion trap electrodes 31*a*, 31*b*, 31*c*, and 31*d*, and the end-cap electrode 33. When the trap RF voltage (FIG. 6H) is applied to the linear ion trap electrodes 31*a*, 31*b*, 31*c*, and 31*d* at an appropriate time delay after the barrier discharge electrode voltage (FIG. 6D) is applied, the sample molecular ions are trapped (accumulated) linearly in the central portion of the linear ion trap electrodes 31*a*, 31*b*, 31*c*, and 31*d*.

(Evacuation Wait Step)

Start of the evacuation wait step is when the pinch valve 105 is closed. A duration of the evacuation wait step is a period while the barrier discharge electrode voltage (FIG. 6D) is applied, and across the valve closing time of the pinch valve 105. Therefore, the evacuation wait step and the ion accumulation step are overlapped with each other. The end of the evacuation wait step is when the pressure of the mass spectrometry section 102 reaches a predetermined pressure of 0.1 Pa or less in which the mass spectrometry is possible. A time period of the evacuation wait step is about 1 to 2 sec.

(Ion Selection Step)

In the ion selection step, in order to select sample molecular ions (target ions) of m/z values within a specific range out of the trapped ions, the auxiliary AC voltage (39*a*) is applied across the linear ion trap electrodes 31*a* and 32*b* as shown in FIG. 6I, and the tap RF voltage (39*b*) is also raised as shown in FIG. 6H, so that a FNF (Filtered Noise Field) process is carried out. Thus, sample molecular ions not having m/z values within the range desired to be measured are ejected from the trap region. Incidentally, the FNF process is omitted if all the trapped sample molecular ions are subjected to the mass separation.

(Ion Dissociation Step)

In the ion dissociation step, a CID (Collision Induced Dissociation) process is applied to the sample molecular ions to generate product ions. As shown in FIG. 6I, an auxiliary AC voltage (39*a*) corresponding to a m/z value of a precursor ion (target ion) as a target of the CID is applied across the linear ion trap electrodes 31*a* and 31*b* to cause the precursor ion to collide with neutral molecules ($N_2$ and/or $O_2$) existing in the mass spectrometry section 102 and to fragment (dissociate) (creation of fragment ions). The precursor ions resonate with the auxiliary AC voltage and are subjected to multi-collisions with neutral molecules (buffer gas) in the trap, and thus being decomposed and creating the product ions. Preferably, the buffer gas has a pressure of about 0.01 to 1 Pa. If the mass separation of the product ions is not needed, the CID process can be omitted.

(Mass Separation Step)

Finally, as shown in FIGS. 6H and 6I, voltage values (peak values) of the trap RF voltages (39*a*, 39*b*) and the auxiliary AC voltage (39*a*) are swept in order that ions are ejected as the flow 25 of the mass separated sample molecular ions from the slit of the linear ion trap electrode 31*a* in a direction to the ion detector 34 in an ascending order of the m/z value. Differences in detection timings at the ion detector 34 caused by differences in the m/z values are recorded in the form of a MS spectrum of mass spectroscopy. In other words, a mass spectroscopic spectrum can be obtained from mass numbers and signal quantities of detected ions. In the mass separation step, the voltage of the ion detector 34 must be turned on as shown in FIG. 6J. Incidentally, since a high voltage which takes time to be stabilized is typically used as the voltage for the ion detector 34, it may be turned on during the ion selection step or the ion dissociation step. This is because the ion detector 34 is supposed to be one such as an electron multiplier to which a high voltage cannot be applied in an environment of a high pressure region. If a photomultiplier, a semiconductor detector, or the like is used for the ion detector 34, the voltage for the ion detector 34 can be always on during operation of the mass spectrometer, and the ON/OFF switching operation can be omitted.

MS/MS measurement is carried out in the aforementioned five steps of the ion accumulation step, the evacuation wait step, the ion selection step, the ion dissociation step, and the mass separation step, and the ion selection step and the ion dissociation step may be omitted in case of a usual MS measurement. If the MS/MS spectroscopy is performed plural times ($MS^n$), the ion selection step and the ion dissociation step may be repeated plural times.

FIGS. 7A to 7J show open/close of the pinch valve 105 (FIG. 7A), a pressure of the barrier discharge region 5 (the inside of the dielectric chamber 1) (FIG. 7B), a pressure of the mass spectrometry section 102 (the inside of the vacuum chamber 30) (FIG. 7C), a barrier discharge electrode (2) AC voltage (FIG. 7D), an orifice (3) DC voltage (FIG. 7E), an in-cap electrode (32)/end-cap electrode (33) DC voltage (FIG. 7F), a trap-bias DC voltage (FIG. 7G), a trap RF voltage (FIG. 7H), an auxiliary AC voltage (FIG. 7I), and ON/OFF of the ion detector 34 (FIG. 7J), in association with a sequence (ion accumulation and evacuation wait—ion selection—ion dissociation—mass scan (mass separation)) of the mass spectrometry by the frequency sweep scheme which is different from the voltage sweep scheme in FIGS. 6A to 6J. The frequency sweep scheme in FIGS. 7A to 7J is different from the voltage sweep scheme in FIGS. 6A to 6J in the mass separation step. In the voltage sweep scheme in FIGS. 6A to 6J, the voltage values (peak values) of the trap RF voltages (39*a*, 39*b*) and the auxiliary AC voltage (39*a*) are swept as shown in FIGS. 6H and 6I, however, in the frequency sweep scheme in FIGS. 7A to 7J, the frequency of the auxiliary AC voltage (39*a*) is swept as shown in FIG. 7I while the voltage values and the frequencies of the trap RF voltages (39*a*, 39*b*) are kept constant as shown in FIG. 7H. Also in the frequency sweep scheme in FIGS. 7A to 7J, ions are ejected in the direction toward the ion detector 34 from the slit of the linear ion trap electrode 31*a* in an ascending order of the m/z value.

Modification of First Embodiment

Figure 8:
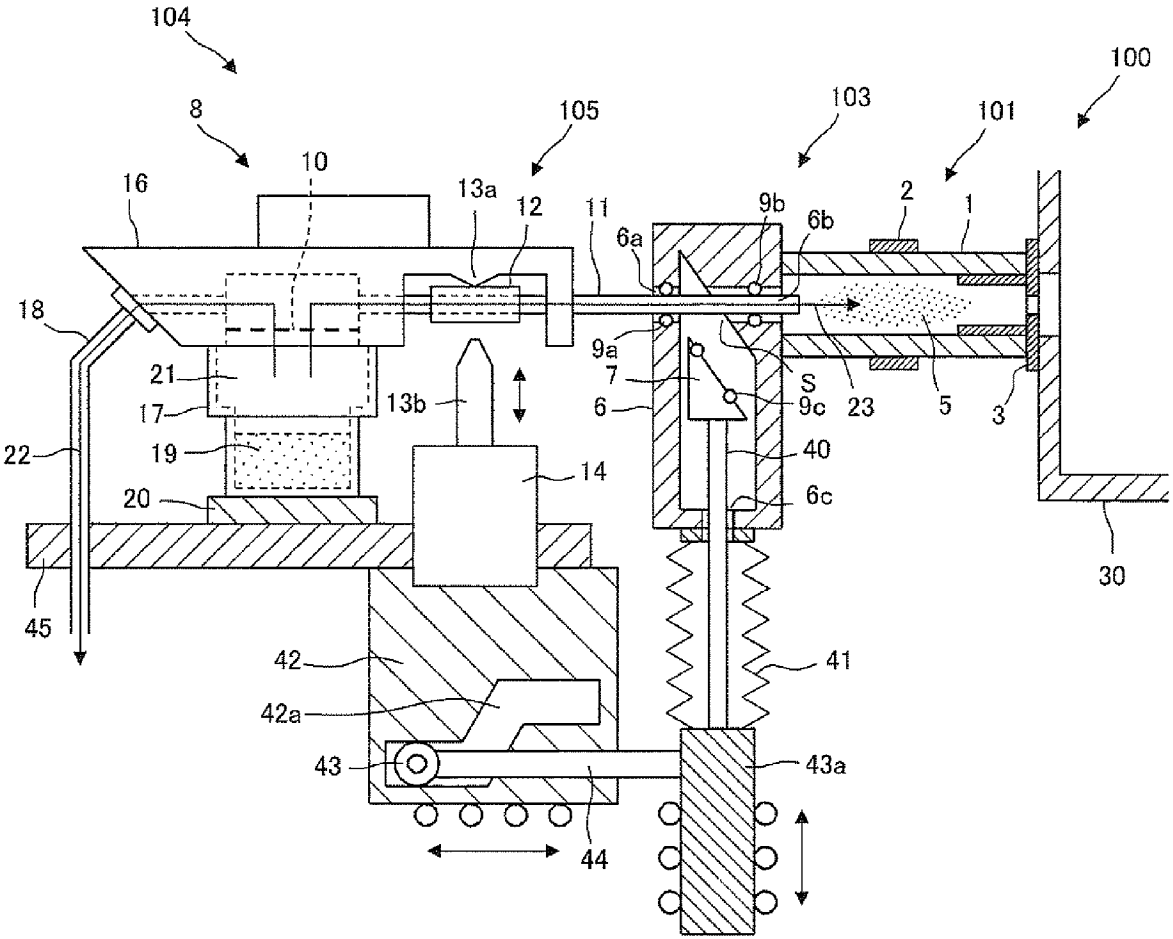
FIG. 8 is a block diagram showing a main part of a mass spectrometer according to a modification of the first embodiment of the present invention.

FIG. 8 shows a block diagram of a main part of the mass spectrometer 100 according to a modification of the first embodiment of the present invention. The modification of the first embodiment is different from the first embodiment in that the grooved cam 42 is attached to the sample introduction base 45. The grooved cam 42 and the sample introduction base 45 integrally constitute the driving slider, the rectilinear motion driving member. On the other hand, the guide roller (follower) 43 is attached to a driven slider (linear motion driven member) 43*a*. The driven slider (linear motion driven member) 43*a* moves integrally with the valving element shaft 40 and the slide valve valving element 7. The same operation and effect as the first embodiment can be also obtained by such a configuration.

Second Embodiment

Figure 9:
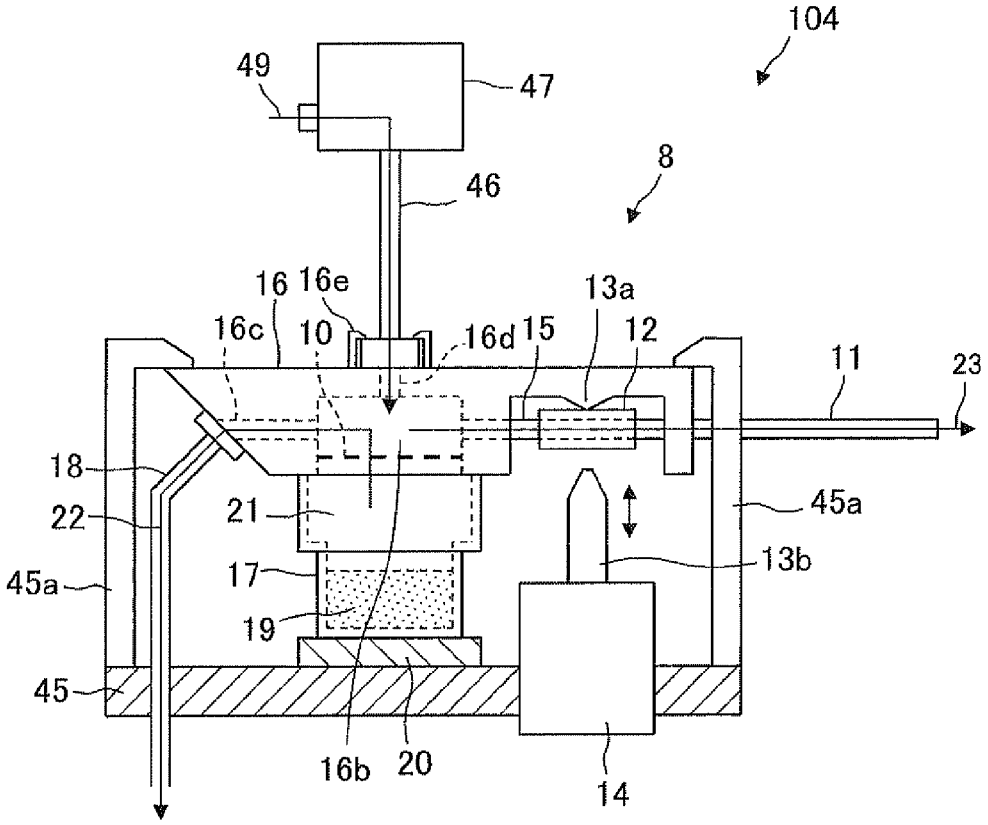
FIG. 9 is a block diagram showing a sample introduction section of a mass spectrometer according to a second embodiment of the present invention.

FIG. 9 shows a block diagram of the sample introduction section 104 of the mass spectrometer according to a second embodiment of the present invention. The second embodiment is different from the first embodiment in that a dilution unit (a dilution pipe 46 and a flow control section 47) for introducing the outside air (atmosphere, fluid) into the gas chamber 16*b* and diluting the sample gas when the cartridge 8 is in the attachment state is included in the second embodiment. The dilution pipe 46 is detachably secured to the cartridge body 16 by hooks 16*e*. The flow control section 47 is supported by the main body of the sample introduction section 104. The dilution pipe 46 is connected to the gas chamber 16*b* via a through hole 16*d* provided on the cartridge body 16. As an outside air flow 49, an appropriate amount of the outside air (atmosphere) adjusted by the flow control section 47 can be taken into the gas chamber 16*b* via the dilution pipe 46 and the through hole 16*d*. In this manner, the sample gas may be diluted in such a case that the concentration of the sample gas is high. Incidentally, the flow control section 47 is connected to the control circuit 38 (see FIG. 1A), and when the concentration of the measurement sample 19 is determined to be high after starting the measurement, the control circuit 38 can automatically adjust the flow control section 47, thereby increasing the outside air for dilution. Or the gas chamber 16*b* is diluted by an appropriate amount of the outside air in advance, and when the concentration of the measurement sample 19 is determined to be low after starting the measurement, the control circuit 38 can automatically adjust the flow control section 47, thereby decreasing the outside air for dilution to enhance the measurement sensitivity. In addition, if there is no means for diluting the sample gas, such as this second embodiment, the carryover can be prevented from occurring if the introduction of the sample is stopped at the time when the concentration of the measurement sample 19 is determined to be high after starting the measurement. When the cartridge 8 is detached from the main body of the sample introduction section 104, the hooks 16*e* are removed, and the dilution pipe 46 and the flow control section 47 remain on the main body of the sample introduction section 104 and can be separated from the cartridge 8. The dilution pipe 46 and the flow control section 47 can be used for the measurement repeatedly. Incidentally, the flow control section 47 can be connected with a cylinder (container) filled with gas (fluid) of known composition.

Third Embodiment

Figure 10:
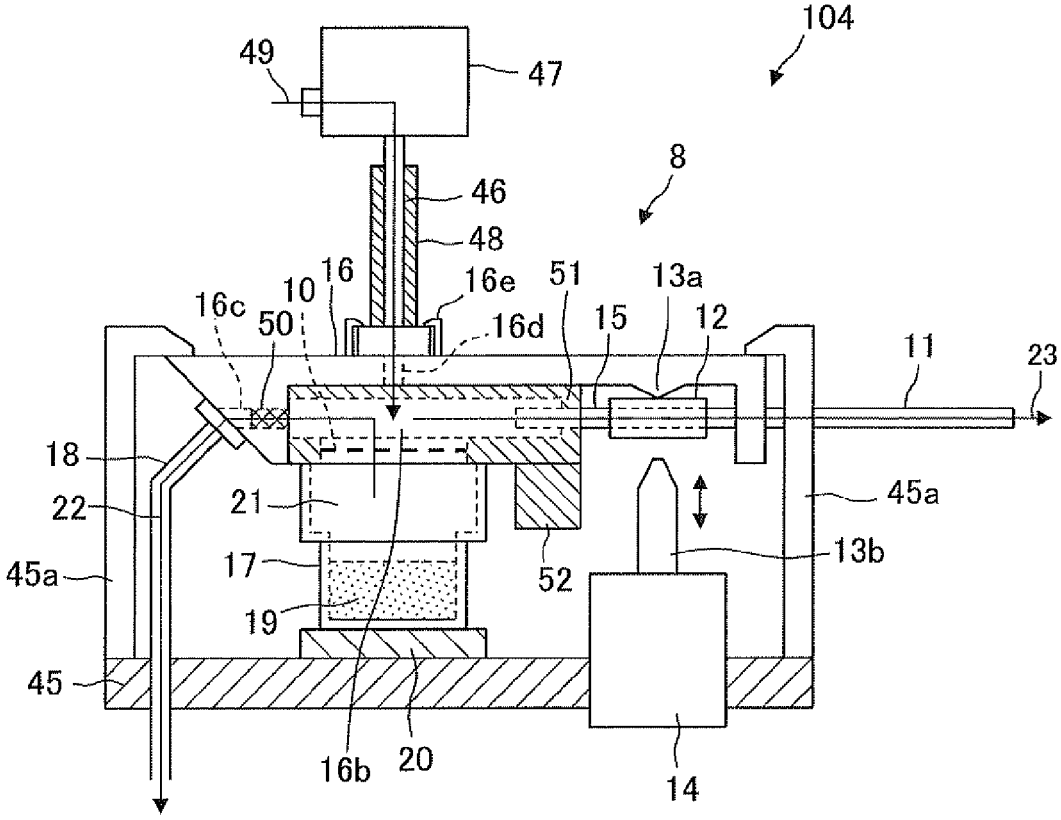
FIG. 10 is a block diagram showing a sample introduction section of amass spectrometer according to a third embodiment of the present invention.

FIG. 10 shows a block diagram of the sample introduction section 104 of the mass spectrometer according to a third embodiment of the present invention. The third embodiment is different from the second embodiment in that a pipe heating heater (fluid heating unit) 48 for heating a fluid in the dilution pipe 46, a metal container heating heater (gas heating unit) 52 for heating the sample gas in the gas chamber 16*b*, and a gas filter 50, which is disposed on the through hole 16*c*, for absorbing the sample gas in the through hole 16*c* are included in the third embodiment. In addition, the gas chamber 16*b* in the second embodiment is changed to a metal chamber of high thermal conductivity which is a gas chamber metal container 51. The gas chamber metal container 51 is heated by the metal container heating heater 52, so that the sample gas therein can be prevented from being cooled to aggregate. In addition, the dilution pipe 46 is also heated by the pipe heating heater 48, and the outside air (atmosphere) is heated when it passes through the dilution pipe 46. Therefore, it is possible to prevent the outside gas flowing into the gas chamber metal container 51 from cooling the sample gas. By these structures, it is possible to hold the sample, which has been vaporized once, without making it aggregate. When the cartridge 8 is detached from the main body of the sample introduction section 104, the pipe heating heater 48 remains on the main body of the sample introduction section 104 and can be separated from the cartridge 8. The pipe heating heater 48 may be used for the measurement repeatedly.

In addition, since the sample gas is evacuated from the through hole 16*c* by the pressure reduction pipe 18, it is possible to suppress the sample gas from flowing into the pressure reduction pipe 18 by providing the gas filter 50 on the through hole 16*c*. It is possible to reduce the residual of the sample gas in the reduction pipe 18. When the cartridge 8 is detached from the main body of the sample introduction section 104, the metal container heating heater 52 and the gas filter 50 can be handled integrally with the cartridge 8.

It should be noted that the present invention is not limited to the first to third embodiments which are described above, and various modification are included. For example, the first to third embodiments described above are those described in detail in order to better illustrate the present invention and are not necessarily intended to be limited to those having all the described components. In addition, apart of structure of an embodiment may be replaced by components of other embodiments, or components of other embodiments may be added to structure of an embodiment. Further, a part of structure of an embodiment may be deleted.

REFERENCE SIGNS LIST

1: dielectric container (dielectric bulkhead)
2: barrier discharge electrode
3: orifice
4: barrier discharge AC power supply
5: barrier discharge region
6: slide valve container (valve container)
6*a*: outside insertion hole
6*b*: insertion hole
6*c*: through hole
7: slide valve valving element (valving element)
8: cartridge
9*a*: first O-ring
9*b*: second O-ring
9*c*: valving element O-ring
10: filter
11: thin pipe (capillary)
12: elastic tube
13*a*: fixed weir (a pair of weirs of pinch valve)
13*b*: moving weir (a pair of weirs of pinch valve)
14: pinch valve driving unit
15: sample gas pipe
16: cartridge body (sample container cap)
16*a*: cartridge handle
16*b*: gas chamber
16*c*, 16*d*: through hole
16*e*, 16*f*: hook
17: sample container
18: pressure reduction pipe (pressure reduction unit)
19: measurement sample
20: heater (heating unit)
21: headspace
22: sample gas flow to be evacuated
23: sample gas flow (to be measured)
24: flow of sample molecular ion
25: flow of mass separated sample molecular ion
26: gas flow to be evacuated (from vacuum chamber)
30: vacuum chamber
31*a*, 31*b*, 31*c*, 31*d*: linear ion trap electrode
32: in-cap electrode
33: end-cap electrode
34: ion detector
35: vacuum gauge
36: turbomolecular pump
37: roughing pump
38: control circuit
39*a*: linear ion trap electrode AC voltage (trap RF voltage plus auxiliary AC voltage)
39*b*: linear ion trap electrode AC voltage (trap RF voltage)
40: valving element shaft
41: vacuum bellows
42: grooved cam (driven slider (linear motion driven member), driving slider (rectilinear driving member))
42*a*: cam slot
43: guide roller (follower)
43*a*: driven slider (linear motion driven member)
44: guide roller shaft
45: sample introduction section base (driving slider, rectilinear motion driving member)
45*a*: hook
46: dilution pipe (dilution unit)
47: flow control section (dilution unit)
48: pipe heating heater (fluid heating unit)
49: outside air (atmosphere) flow
50: gas filter
51: gas chamber metal container
52: metal container heating heater (gas heating unit)
100: mass spectrometer
101: ion source
102: mass spectrometry section
103: slide valve (on-off valve)
104: sample introduction section
105: pinch valve
S: opening surface of insertion hole 6*b*
D1: first predetermined distance
D2: second predetermined distance

The invention claimed is:

1. A mass spectrometer comprising:

a mass spectrometry section that separates an ionized sample gas;

an ion source that has an internal pressure thereof reduced by differential pumping from the mass spectrometry section and ionizes the sample gas;

a thin pipe that introduces the sample gas into the ion source;

an insertion hole which is provided on the ion source and connects the thin pipe and the ion source while sealing a gap between the thin pipe and the insertion hole by inserting the thin pipe through the insertion hole, and disconnects the thin pipe from the ion source by removing the thin pipe; and an on-off valve for opening and closing the insertion hole, wherein the thin pipe and the on-off valve approach each other in accordance with the forward movement of the thin pipe to be inserted to the insertion hole, and the on-off valve starts the valve opening to pass the thin pipe through the insertion hole when the distance between the thin pipe and the on-off valve is shortened to a first predetermined distance, and the thin pipe is removed and away from the through hole in accordance with the backward movement of the thin pipe to be removed from the insertion hole, and the on-off valve completes the valve closing when the distance between the thin pipe and the insertion hole is lengthened to a second predetermined distance, the mass spectrometer further comprising:

a driving slider which is a rectilinear motion driving member, and moves integrally with the thin pipe to perform the forward movement and the backward movement;

a driven slider which is a linear motion driven member, and moves integrally with the on-off valve;

a cam slot which is provided on one of the driving slider and the driven slider; and a follower which is provided on the other of the driving slider and the driven slider, and opens and closes the on-off valve by moving relatively along the cam slot, wherein when the distance between the thin pipe and the on-off valve is longer than the first predetermined distance in the forward movement, and when the distance between the thin pipe and the insertion hole is longer than the second predetermined distance in the backward movement, the driven slider stays in a state that the on-off valve is closed even if the follower moves relatively along the cam slot.

2. The mass spectrometer as set forth in claim 1, comprising:

a valve container which is connected to the ion source via the insertion hole, and accommodates the on-off valve; and an outer/air-side insertion hole which is provided on the valve container so that a central axis thereof coincides with an extension of a central axis of the insertion hole, and connects the thin pipe and the valve container while sealing a gap between the thin pipe and the outside insertion hole by inserting the thin pipe through the outside insertion hole, and disconnects the thin pipe from the valve container by removing the thin pipe, wherein when the distance between the thin pipe and the on-off valve is shortened to the first predetermined distance along with the forward movement, and when the distance between the thin pipe and the insertion hole is lengthened to the second predetermined distance along with the backward movement, the thin pipe is inserted through the outside insertion hole, and the thin pipe and the valve container are connected with each other while sealing a gap between the outside insertion hole and the thin pipe.

3. The mass spectrometer as set forth in claim 2, wherein the on-off valve comprises:

a valving element which closes the opening surface of the insertion hole on the side of the valve container for closing the valve;

a shaft which penetrates a through hole provided on the valve container and supports the valving element; and a bellows which is capable of moving the shaft while maintaining a seal in the vicinity of the through hole.

4. The mass spectrometer as set forth in claim 1, wherein a perpendicular of an opening surface of the insertion hole on the far side of the ion source is inclined with respect to the central axis of the insertion hole, the on-off valve includes a valving element which closes the opening surface for closing the valve, and a direction in which the valving element moves for opening or closing the on-off valve is not in parallel with the opening surface.

5. The mass spectrometer as set forth in claim 1, wherein the cam slot is provided on the driven slider, and the follower is provided on the driving slider.

6. The mass spectrometer as set forth in claim 1, wherein when the thin pipe is in a state of being inserted through the insertion hole, in the forward movement and the backward movement, the driven slider stays in a state that the on-off valve is open even if the follower moves relatively along the cam slot.

7. The mass spectrometer as set forth in claim 1, comprising:

a sample container in which a measurement sample is placed, and the sample gas is generated by vaporizing the measurement sample;

an elastic tube that connects the sample container and the thin pipe, and is openable and closable;

a pair of weirs which is provided facing each other to sandwich the elastic tube, so as to close or open the elastic tube by moving close to or away from each other; and a cartridge that integrates the sample container, the thin pipe, and the elastic tube, and is detachable in a lump from a main body of the mass spectrometer.

* * * * *